US006222503B1

(12) United States Patent
Gietema et al.

(10) Patent No.: US 6,222,503 B1
(45) Date of Patent: Apr. 24, 2001

(54) SYSTEM AND METHOD OF INTEGRATING AND CONCEALING ANTENNAS, ANTENNA SUBSYSTEMS AND COMMUNICATIONS SUBSYSTEMS

(76) Inventors: William Gietema, 5728 Moss Creek Trail, Dallas, TX (US) 75252; Richard R. Harlan, 4911 Haverwood La. #3437, Dallas, TX (US) 75287

( * ) Notice: Subject to any disclaimer, the term of this patent is extended or adjusted under 35 U.S.C. 154(b) by 0 days.

(21) Appl. No.: 09/005,250

(22) Filed: Jan. 9, 1998

Related U.S. Application Data

(60) Provisional application No. 60/035,799, filed on Jan. 10, 1997.

(51) Int. Cl.[7] ..... H01Q 1/12

(52) U.S. Cl. ..... 343/890; 343/878; 343/700 MS

(58) Field of Search ..... 343/878, 879, 343/890, 891, 892, 700 MS; H01Q 1/12

(56) References Cited

U.S. PATENT DOCUMENTS

| | | | | |
|---|---|---|---|---|
| 4,725,846 | | 2/1988 | Hendershot | 343/792 |
| 5,003,318 | * | 3/1991 | Berneking et al. | 343/700 MS |
| 5,048,641 | | 9/1991 | Holcomb et al. | 182/127 |
| 5,233,626 | | 8/1993 | Ames | 375/1 |
| 5,283,549 | * | 2/1994 | Mehaffey et al. | 340/521 |
| 5,294,938 | | 3/1994 | Matsuo et al. | 343/829 |
| 5,349,362 | | 9/1994 | Forbes et al. | 343/720 |
| 5,375,144 | | 12/1994 | Ehsani et al. | 375/38 |
| 5,446,473 | * | 8/1995 | Nielsen | 343/890 |
| 5,502,715 | | 3/1996 | Penny | 370/26 |
| 5,581,958 | * | 12/1996 | Cote | 52/40 |
| 5,633,645 | * | 5/1997 | Day | 343/700 MS |
| 5,641,141 | * | 6/1997 | Goodwin | 248/218.4 |
| 5,757,324 | * | 5/1998 | Helms et al. | 343/700 MS |
| 5,856,804 | * | 1/1999 | Turcotte et al. | 342/371 |
| 5,872,545 | * | 2/1999 | Rammos | 343/770 |
| 5,886,738 | * | 3/1999 | Hollenbeck et al. | 348/151 |
| 5,898,412 | * | 4/1999 | Jones et al. | 343/872 |
| 5,926,136 | * | 7/1999 | Ohtsuka et al. | 343/700 MS |
| 5,926,145 | * | 7/1999 | Honma | 343/720 |
| 5,963,178 | * | 10/1999 | Jones | 343/890 |
| 5,990,838 | * | 11/1999 | Burns et al. | 343/702 |
| 6,006,069 | * | 12/1999 | Langston | 455/62 |

* cited by examiner

*Primary Examiner*—Tan Ho
*Assistant Examiner*—Shih-Chao Chen
(74) *Attorney, Agent, or Firm*—Smith, Danamraj & Youst, P.C.

(57) ABSTRACT

A system and method of deploying a plurality of aesthetically unobtrusive radio frequency (RF) antenna systems or complying with zoning ordinances and other restrictive covenants, and for providing an array configuration which is intelligently controlled to overcome many of the limitations of conventional RF antenna systems. Antennas and communications systems components including filter-preamplifier, frequency-converter, and beam-selection/manipulation subsystems are concealed by packaging and integrating them within common pole-like objects and panel-like structures. The pole-like objects include utility poles, street lamps, flagpoles, signs, church steeples, columns, railings, and roof balconies. Panel-like structures include advertising billboards and road signs, and building panels. The concealed antennas and related components are then integrated into larger scale antenna subsystems. The antenna subsystems are connected to an intelligent controller to provide enhanced performance, functionality, and service in communications systems.

38 Claims, 38 Drawing Sheets

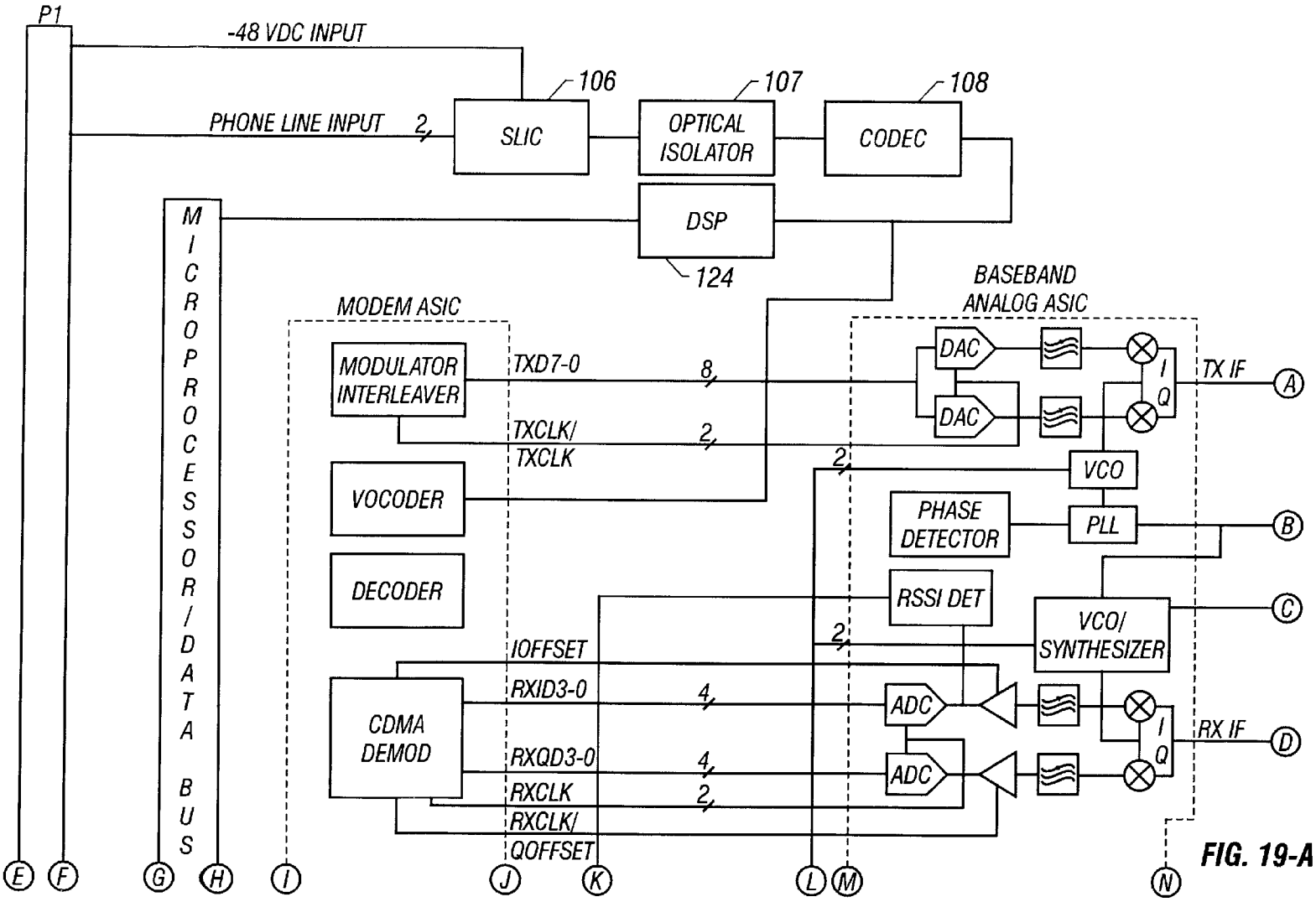
FIG. 19-A

SYSTEM AND METHOD OF INTEGRATING AND CONCEALING ANTENNAS, ANTENNA SUBSYSTEMS AND COMMUNICATIONS SUBSYSTEMS

PRIORITY STATEMENT UNDER 35 U.S.C. §119(e) & 37 C.F.R. §1.78

This nonprovisional application claims priority based upon the prior U.S. provisional patent application entitled, "Integration and Concealment of Antennas and Communications Subsystems", Provisional application No. 60/035,799, filed Jan. 10, 1997, in the names of William Gietema Jr. and Richard R. Harlan.

FIELD OF THE INVENTION

The invention relates generally to radio frequency antennas and related components, and more particularly, to aesthetically unobtrusive, base station antennas and antenna subsystems for use by commercial communications service providers to transmit and receive radio signals.

BACKGROUND OF THE INVENTION

It would be advantageous for providers of commercial of communications, data transfer services, and identification systems to have a system and method of deploying a plurality of aesthetically unobtrusive, base station antennas and antenna subsystems, thereby avoiding or complying with zoning ordinances or other restrictive covenants of urban, suburban, and rural communities. While increasing public acceptance and service, the invention would also reduce site location, acquisition, and maintenance costs for radio base stations. Many of the concealment features of the invention described herein are useful in cellular telephone systems as well as automatic-identification and data-collection systems such as toll collection, utility billing, security services, asset (vehicle, logistics) tracking and others.

Due to the conditions that are imposed by physics of the art, the size of any antenna device is related to the wavelength of the electromagnetic radiation that is being propagated and the effective aperture gain and pattern characteristics of the antenna that is needed to meet the requirements of the particular communications or other systems. Usually, particularly in the case of terrestrial communications systems, the antenna dimensions are large enough to be readily noticed. As antennas are typically protected behind radomes in rectangular or cylindrical packages (primarily to prevent them from being damaged by the environment or mishandling), the resulting objects often have the unsightly appearance of large, rectangular boxes hanging from towers or water heaters and other protrusions on rooftops. To compound the problem, a variety of antennas of varying sizes and shapes for several different systems are often found on a common tower that is often the most visually objectionable apparatus. Besides aesthetics, potential performance problems (i.e., interference due to noise or intermodulation signals that emanate from adjacent systems) can also result from such collocation of antennas.

From the prior art and as described herein, an antenna may be comprised of one or more radiating elements that may be arranged and combined in a variety of ways to achieve the desired, effective aperture and spatial radiation (or reception) characteristics or patterns. Attempts in the prior art to conceal antennas were directed toward mobile antennas, which were mounted on vehicles, or rooftop-mounted antennas that were directed primarily toward use by hobbyists. Application of these principles to antenna systems suitable for mass deployment in commercial communications systems has not been successful. In particular, harmonious integration of stationary antennas and related components that are found in base stations and repeaters into common objects has not been successful.

In addition to the physics of the art, many factors influence the size and configuration of an antenna that is used in a particular application. Top-level system requirements include the following: efficient use of the allotted electromagnetic spectrum, user coverage (range and area), use satisfaction (voice quality, data integrity, continuity of service, low call drop rate, etc.), minimal interference with other systems, and compliance with regulatory restrictions. In turn, these requirements ultimately translate to specifications for the subsystem hardware comprising the infrastructure of the communications systems. Of these, few are of greater importance than the location (or site) of the base station and placement of the antennas. Because the characteristics of site locations are varied and always less than ideal, the size, number and type of antenna to be used becomes increasingly critical to the ultimate performance of the system.

Securing a suitable site for locating the base stations or repeaters and the associated antennas is a difficult and expensive proposition. Site locations are a scarce commodity because, in general, the preferred locations are the highest available ground relative to the surrounding terrain within the intended coverage area. Preferably, the line of sight will also be free of obstructions that will reflect electromagnetic waves from the direction of the desired coverage. As such, the aesthetics problem is greatly exacerbated; the antennas are ideally mounted on towers atop the most prominent, visible locations within the surrounding landscape. For these reasons, site owners often incur significant expenses such as brokerage fees, land acquisition costs, permit fees, lobbying expenses for zoning rights, insurance premiums, costs for tower construction, etc. Therefore, site owners must lease tower 'space' to service providers at substantial premiums.

Once the site location is determined, commercial wireless communications systems typically use the same basic approach to system performance and reduce operating costs associated with base station or repeater (antenna) sites. First, they transmit at the maximum power that the Federal Communications Commission (FCC) allows. Second, they use the highest gain with the appropriate radiation pattern (i.e., the largest) antenna that the location permits to maximize range and coverage. Third, the antenna is mounted as high as the site will permit to further increase range. Fourth, they use multiple antenna arrangements and receiver channels for diversity, a common means of improving system performance, in each sector at a site to help mitigate fading due to multipath. Another common technique to enhance uplink sensitivity is to mount a low-noise preamplifier with filters below and external to the antenna on the tower which adds to the unsightly clutter at the site. However, shadowed or otherwise uncovered areas remain common and result in 'dead spots' or 'drop-outs' where service is interrupted.

Those who are skilled in the art are designing and deploying super or "smart" antenna in the form of multibeam, switched or steerable arrays that require many more antenna elements, and may form twelve or more sectors at a particular site. Unfortunately, these features translate to a larger, more obtrusive antenna structure. While promoting the ability to avoid interference, these super-antenna systems are capable of significant range and penetration. However, these clustered, collocated antenna systems do not overcome some fading, shadowing, and other propagation problems. Additionally, maintenance costs and down time are increased due to system complexity and the inability of these system to compensate for certain failures.

From a cost standpoint, designers of existing cellular systems to minimize the number of base station sites because of several economic factors. Obviously, the purchase cost of the base station as well as tower and shelter construction costs are considerable. In addition, the costs of maintenance, leasing of tower space, energy, and insurance constitute significant operational overhead. Because sites are hard to find, more complex and visually objectionable antenna arrangements are being deployed to maximize coverage at each location. In turn, the visual as well as electromagnetic pollution that the public finds objectionable increases their resistance to additional sites within their communities. In fact, site planning and acquisition costs are among the most significant obstacles in terms of money and time.

Deployment of the most modern and sophisticated cellular radio communications systems are being delayed and becoming increasingly expensive because of the difficulty and lengthy procedures involved in obtaining sites. Typically, these systems require a large number of sites as a result of technical limitations Additionally, new sites must continually be found as a result of technical problems with collocation as well as competitive restrictions on existing sites. When sites are determined, more antennas and associated equipment (diversity and 'smart' antenna systems) are deployed to achieve the most performance within the constraints of the location. This, however, intensifies the problems. Meanwhile, the general public is becoming increasingly and vehemently intolerant of hideous antennas and towers in their local environment. Therefore, requests for zoning variances for new sites are often rejected by city councils. In turn, the radio system planners must then search for another new location, modify the system design based on the characteristics of the new site, and repeat the zoning process. Meanwhile, service providers who have spent billions in recent FCC auctions of personal-communication-systems (PCS) spectrum licenses are facing financial ruin in the wake of rising costs and time limits on initiation of service that were imposed by the federal government.

To reduce the objectionable aesthetics of base station antenna systems, attempts have been made to disguise conventional antennas and supporting structures as flagpoles, hide them behind billboards, position them within large utility towers, mount them on street lamps or smaller utility poles, mount them on decorative towers, and so on. These attempts have achieved limited success in terms of aesthetics. Often, in the case of pole disguises, they do not appear "natural" and their size or shape is out of proportion with the typical structure. While increasing the ugliness of the tower, utility tower installations are limited in availability and location. Decorative towers often appear tacky or pretentious (as with the "Eiffel Tower" replicas). Positioning antennas behind billboards has been more successful since they are large relative to the antennas. However, billboards are highly restricted and regulated with fewer new ones being erected due to unpleasant aesthetics.

Although there are no known prior art teachings of a solution to the aforementioned deficiency and shortcoming such as that disclosed herein, U.S. Pat. No. 5,048,641 to Holcomb et al. (Holcomb) and U.S. Pat. No. 5,349,362 to Forbes et al. (Forbes) discuss subject matter that bears some relation to matters discussed herein. Holcomb discloses an antenna located in the hollow outer sides of a fiberglass ladder which is mounted on the rooftop of a van. The antenna operates with radio communication equipment inside the van. However, the antenna of Holcomb is for a mobile unit, and does not teach or suggest concealing base station antennas or distributing concealed base station antennas in a distributed array.

Forbes discloses an antenna which is concealed in a vent pipe projecting from the roof of a house, for use by radio operators in areas with restrictive covenants against roof-top antennas. However, Forbes does not teach or suggest concealing base station antennas or distributing concealed base station antennas in a distributed array.

Review of each of the foregoing references reveals no disclosure or suggestion of a system or method such as that described and claimed herein.

It would be advantageous to have a system and method of deploying a plurality of aesthetically unobtrusive, RF base station antenna subsystems for complying with zoning ordinances or other restrictive covenants, and for providing an array configuration which may be intelligently controlled to overcome many of the limitations of conventional base station antenna systems.

SUMMARY OF THE INVENTION

In one aspect, the present invention is a method of concealing a base station radio frequency (RF) antenna and associated antenna components in a pole-like object. The method comprises constructing an elongate tube from a dielectric material, and mounting the antenna and the antenna components inside the elongate tube. The tube may have an internal support shaft, and may be constructed in the shape of a common pole-like object such as a flagpole, a street lamp, a sign post, a utility pole, a church steeple, a vertical column in a building, or a horizontal rail in a building. The tube may be mounted as the top portion of the common pole-like object, and the step of mounting the antenna inside the elongate tube may include mounting a plurality of antenna elements in an array configuration. The pole-like object may include an enclosure at the base thereof, and the antenna components may comprise a picocell base station in a cellular telephone network.

In another aspect, the present invention is a method of concealing a base station radio frequency (RF) antenna and associated antenna components in a panel-like structure. The method comprises the steps of constructing the panel-like structure from a dielectric material, and mounting the antenna and the antenna components behind the panel-like structure. The panel-like structure may duplicate a common panel-like structure such as a billboard, a street sign, a building spandrel panel, a building roof panel, a ceiling tile, or a building wall panel. The step of mounting the antenna behind the panel-like structure may include mounting a plurality of antenna elements in an array configuration. The panel-like structure may include a wall-mounted enclosure mounted on the back surface thereof, and the antenna components may comprise a picocell base station in a cellular telephone network.

In yet another aspect, the present invention is a concealed base station radio frequency (RF) antenna comprising an elongate tube constructed from a dielectric material in the shape of a common pole-like object, and at least one antenna element and associated antenna components mounted inside the elongate tube. The base station RF antenna may alternatively comprise a panel-like structure constructed from a dielectric material and at least one antenna element and associated antenna components mounted behind the panel-like structure.

In still another aspect, the present invention is a method of deploying a plurality of aesthetically unobtrusive base station radio frequency (RF) antennas and antenna subsystems. The method comprises the steps of concealing each antenna in a common structural object having a geographic location and sufficient vertical for the antenna to provide RF coverage of a desired area, electronically connecting each antenna to an associated antenna subsystem, and electronically connecting each antenna subsystem to an intelligent controller. The common structural objects may be common pole-like objects constructed of dielectric material, common panel-like structures constructed of dielectric material, or a combination of both. Each of the antennas may comprise a plurality of antenna elements configured to form an array, and the step of electronically connecting each antenna to an associated antenna subsystem may include connecting each antenna array to a beam forming and steering subsystem which controls an antenna pattern created by each antenna array. Then if it is detected that one of the plurality of antennas has malfunctioned, the intelligent controller may determine whether a blind spot has been created by the malfunctioning antenna. If it is determined that a blind spot has been created by the malfunctioning antenna, the intelligent controller directs the beam forming and steering subsystems of antennas neighboring the malfunctioning antenna to reform and redirect their antenna patterns to cover the blind spot.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF THE INVENTION

Figure 1A:
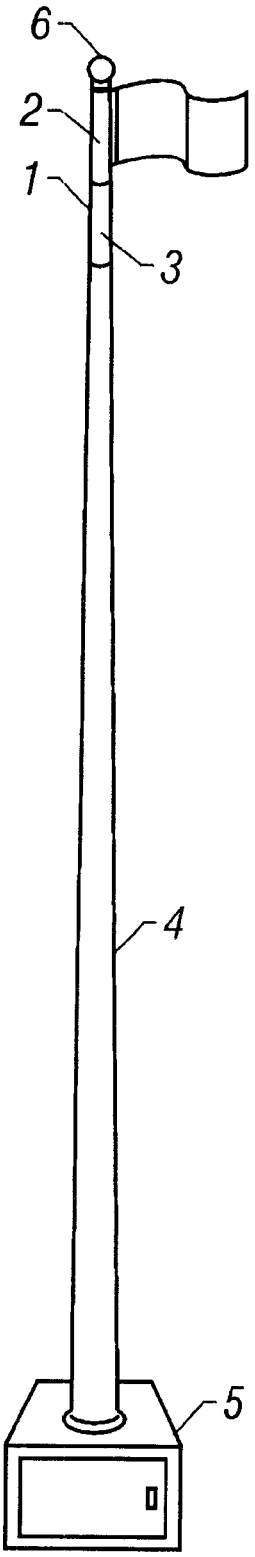
FIGS. 1A and 1B are front elevational views of as flagpole and as lamp post, respectively, in which concealed antennas, antenna-repeaters, antenna subsystems, and miniature base stations for picocells have been implemented in accordance with the teachings of the present invention.

In contrast to the prior art as described above, the present invention offers a novel approach to overcome the interrelated problems of aesthetics, system performance, and site costs including planning, acquisition, construction, and maintenance. The present invention differs from prior art methods by harmoniously integrating antennas along with other base station elements into structures that truly appear and function like the ones they replace. In essence, the present invention provides a highly distributed, spatially diverse, easily maintainable antenna subsystem that is concealed within common pole-like and panel-like objects that are found in the urban landscape.

Once the site acquisition problem is diminished, the designers of the system can better focus on the opportunity to integrate a plurality of antennas and subsystems into higher-level, optimally performing systems. By greatly increasing the number of lower-cost, geographically dispersed site locations, the individual antenna sites can be advantageously redundant and can be utilized to dynamically adjust and distribute system capacity, to mitigate multipath, and to avoid interference, as well as overcome equipment breakdowns. Indeed, as described in the prior art, spatial diversity can be obtained, particularly in spread-spectrum systems such as CDMA, using a plurality of linear repeaters which are employed to provide fade-free communications. Therefore, the primary goals of most smart antenna systems, increased coverage and fade-free reception, are also accomplished.

In the present invention, an abundance of smaller, less expensive, easily maintained antenna subsystems are dispersed throughout the urban environment within existing right of ways. The antenna subsystems are concealed in order to comply with zoning covenants and variances to significantly reduce site acquisition and planning costs. For control and interface with the primary cellular base station, the distributed antenna subsystems, or repeaters, are linked to one or more master antenna systems that may be concealed, for example, within a tall building or other super-site installation. Coverage is increased via the abundance of antennas with fewer line-of-sight and other propagation restrictions. Interference is managed by transmitting at significantly lower power levels. Natural and man-made obstructions and boundaries then serve to reduce co-channel interference from other cells. Fading is mitigated using the diversity provisions of the multiple repeaters and special signal processing techniques. Similarly, the distributed antenna subsystems can be configured as complete, miniature base stations that are radio-frequency linked to a super site or satellite for data transfer and control. Planning of cellar systems is therefore simplified.

On a smaller scale, the present invention may be utilized to enhance existing systems by utilizing concealed antennas or antenna-repeaters to fill in shadowed areas or areas where typical antennas have an objectionable appearance. Additionally, concealed antennas that offer service providers access to a large number of relatively inexpensive site locations can be more widely distributed in smaller cells. Lower transmitter power can be utilized in base stations resulting in lower equipment and operating costs. Mobile phones can also be operating at lower power because the uplink path to the nearest antenna is shorter and less obstructed. This, of course, increases battery life for the handsets. The present invention enables more intensive and creative use of the allocated frequency spectrum can be achieved.

Since pole-type structures including street lamps, utility poles, supports for roadway signs, and flagpoles, are usually made of metal tubes, it has not been obvious to conceal antennas and related components inside the pole; electromagnetic radiation will not penetrate a solid metal tube. In the present invention, the tube (or sections of the tube) are made of a suitable dielectric material serving as both a radome and support. An extruded-metal, carbon-fiber or other internal backbone may provide structural support as well as a provision for mounting of equipment and routing cables within the pole-like antenna. The radiating elements of the antenna are then concealed by hiding them behind the dielectric outer surface, by laminating the elements to the back side of the dielectric outer surface (i.e., clamping, fastening, adhering or otherwise mounting the elements to the back side), or even embedding the elements within the dielectric outer surface itself, in any pole-like structure of sufficient diameter.

In addition, the lower section of the pole and its base may house the electronic components that are associated with the repeater. In one embodiment, the base structure contains the electronic components of a small base station, or "picocell", that communicates with the main antenna system via a microwave link or cable for a direct T1 path.

Street lamps are quite common and considered a necessity for new streets and highways in most urban and suburban communities. Although buried utility lines are aesthetically preferable, utility poles are still required in many cases of community development. Zoning restrictions in urban and communities have very few or no restrictions on street lamps and poles. Where there is a high rate of cellular phone usage, street lamps are profuse, particularly along city streets and freeways. Utility poles are almost as common. Flagpoles are also profuse, with nearly every U.S. post office, federal, state or local government building, public school, or city park having one or more flagpoles, Often, especially in Texas, multiple flagpoles are located in close proximity so that the state flag can be prominently displayed. Many business, educational, entertainment and commercial centers including shopping malls, auto malls, industrial parks, college campuses, and sports facilities display prominent flags on tall flagpoles. If currently existing, most of these structures are grandfathered by new or revised zoning covenants.

Most large street lamps and flagpoles are fabricated from long, metal tubes or extrusions to provide a structure from which to support the lamp or display the flag that is strong enough to withstand wind loading. As such, these structures bear an obvious resemblance to a monopole antenna. Unfortunately, the operating wavelength of such an antenna (four times the antenna's length), would be too long to be useful in current and emerging wireless communications systems that operate at wavelengths on the order of one foot or less. Although the pattern characteristics of a monopole are not always useful in base station applications, a subsection of the pole may conceal a monopole element of the desired length. By concealing multiple antenna elements arranged in a high-frequency antenna array within a street lamp or flagpole, the present invention achieves an array length that is often prohibited by zoning restrictions due to the visual impact of as large antenna array. Thus, increased antenna gain is achieved.

In dense urban areas, street lamps, utility poles, and traffic signal supports are some of the most prevalent structural objects that are suitable for integrating antennas. However, the present invention also conceals antennas and related devices in flat, panel-like objects and column-like structures such as advertising billboards and road signs that are suitable structures for concealing antenna arrays. Other panel-like objects include building fascia, soffits, ornamentation, window systems, window-like panels, curtain wall components such as horizontal railings, spandrel panels, framed units, mullions, and column covers, sheathings, and other roof or wall coverings. With antennas embedded in these panel or column-like features, they are creatively concealed within the cladding and framework of many buildings. Pole-like or panel-like antennas that are concealed within street lamps, flagpoles, billboards and the like are also useful in toll collection, asset tracking, security and other automatic identification systems that are based on radio-frequency transmissions.

With antennas and repeaters located in some or all of the common objects or structures that are distributed throughout any urban area, the present invention then systematically organizes or groups the antennas or repeaters into arrays and links the arrays via high-frequency, highly directional, wireless or other means to common base stations or satellites to create what will be referred to as "urban supercells".

Important advantages are realized using the urban supercell of the present invention. First, many antennas and repeaters within pole-like structures may be operated at lower transmitting power to reduce costs and lessen health concerns. By intentionally limiting the range of coverage from each antenna, interference and multipath effects are reduced while providing valuable coverage at street level. Temporal reallocation of frequency bands (frequency reuse patterns) between antenna-repeaters or picocells to meet fluctuating service demands is achievable by controlling the repeater frequency and output power and, if necessary, the antenna characteristics. To augment 911 emergency service, the location of the emergency call can be more accurately determined and tracked along city streets and expressways by measuring the received signal strength or other parameters that are received between adjacent antenna-repeaters or picocells and computed using relatively simple statistical and triangulation algorithms. By introducing redundancy and variable overlap within each supercell, a self-repairing network is obtained which significantly reduces or virtually eliminates dropped calls or periods of interrupted service due to base station outages.

Communications systems employing satellite links also benefit from the urban supercell. By locating high-gain arrays of antenna elements and related components within capstones, roof panels, or other panel-like structures that blend with the architectural appearance, the link from the urban supercell master antenna to the satellite provides superior performance that is easily and electronically steerable toward the satellite which may not be geosynchronously orbiting. The urban supercell may also function as a repeater in a satellite-based system to provide coverage within dense urban areas, particularly at street level, where blockage and shadowing is normally experienced. Alternatively, the master antenna can be implemented as a satellite network that achieves desired coverage and uses concealed, antenna-repeater devices as herein described. The concealed, antenna-repeater invention also acts as an interface between the satellite-based systems using one band of the frequency spectrum and established or planned terrestrial systems and handsets which operate over a different band.

The present invention not only provides improved street-level communications involving pedestrians and vehicles, but also provides better RF penetration into tall buildings within densely developed, downtown areas, and improved coverage for the near-downtown areas, By creatively integrating the radiating elements of the antenna, as well as related components, within the fascia, window-like panels, decorative panels, curtain-wall systems, or other architectural adornments, any sufficiently tall building can provide the structure for concealing various antenna systems. The basic implementation consists of a simple array of multiple radiating elements that are arranged on the sides of the building to achieve the desired pattern and effective aperture or gain. These arrangements can be used to achieve coverage outside the building and even penetration into adjacent buildings.

Another major benefit of concealing antennas within the components of the curtain-wall construction system, is the ability to direct some antennas inward and distribute them around the building perimeter. Thus, antenna subsystems and even complete base stations (picocells) can be layered up and down the building.

In a much more sophisticated implementation, the antenna elements are appropriately and variably combined in matrices to form a very large, spatially steered- or switched-beam, phased array on single and multiple structures. Such a system provides enough directional gain to penetrate other buildings and provides coverage well beyond the downtown area if desired. Applying the advanced software, microprocessor, and digital-signal-processing technologies that are currently available, the intelligent system is reconfigurable in terms of patterns and gain to adapt to temporally variable service demands, provide spatial diversity, perform interference mitigation, facilitate direction finding for 911 emergency service, and other functions beyond the capability of existing communication systems.

The urban supercell invention extends superior coverage to suburban residential areas as well. The master antenna site can be concealed in a large building as previously described. The master antenna then links to antenna repeaters or picocells that, in turn, link to indoor and outdoor mobile radiotelephones or other wireless communications devices, as well as shadowed antenna repeaters or picocells. Densely and widely dispersed, antenna repeaters or picocells that are concealed within utility poles or street lamps throughout suburban areas provide better coverage, reduced shadowing and other benefits as previously described. But, because of lower ARN height, the angle of elevation from the ARN to a mobile inside the residence is reduced and better penetration is provided through windows and walls. To ease public acceptance in residential communities, these benefits are realized using lower transmitter power than with conventional systems.

Another aspect of the invention is a wireless interface that, when installed and concealed within a residence, permits common wireline voice and data terminals to communicate over a wireless, cellular telephone system in a manner that emulates a conventional wireline network in both function and appearance to the user. Much engineering activity is currently being directed toward designing wireless systems within the home for voice and data communications. Wireless local loop (WLL) and PCS phone systems that are becoming available for the home or office include radio telephones that are packaged to resemble common home and office phones. Most wireless residential configurations consist of a large, bulky, wireless phone set with a large, built-in battery and an external AC adapter. These wireless phones communicate with indoor wireless microcells, indoor wireless private branch exchanges (WPBX), similar systems outside the office complex, or the conventional, outdoor cellular systems. Such systems may be quicker and less expensive to implement in areas lacking the wireless infrastructure, but such wireless systems within the home currently suffer from several disadvantages such as indoor multipath problems and added complexity when compared to simple, common, wireline-based phone systems and usage procedures.

Although technology is reducing the multipath problems somewhat, other problems still remain. Within the home, mobile phones typically must be connected to a battery charger after being used outdoors all day. This constrains the mobile with a wire to the AC outlet. In addition problems exist when several users at one residence simultaneously share ("party-line") a conversation with another location. An existing method of providing this service utilizes multiple wireless telephone sets as independent, wireless lines within the home in a conference call arrangement. However, this arrangement is cumbersome and expensive, and may suffer from the multipath environment within the home. If the link is external, poor penetration of the signals through the building may adversely affect performance. Anther method is to adapt the wireless telephone to a wireline within the home and share the conversation using conventional wireline phones.

Residential customers demand a higher level of service quality when a wireless service provider seeks to compete directly with a wireline service provider. Low bit-error rates and link integrity (no fading or dropouts) are essential parameters that are associated with providing high quality service on par with wireline systems. By concealing a stationary antenna on the exterior of the residence, a stable link is provided to an antenna-repeater or picocell that may be concealed in a nearby street lamp or other object as previously described. Particularly with CDMA systems which employ power control, the uplink power level and vocoder rates can be adjusted by the system to offer higher levels of service at premium rates.

Avoiding the cost and complications of creating a wireless system to ensure that a mobile telephone provides access both inside and outside the home, the major components of a cellular phone are integrated to a subscriber-line interface circuit (SLIC) using a digital-signal processor along with other hardware and software forming a device that provides a wireless interface to an outdoor cellular network for residential wireline. Prior art provides a device to interface a wireline telephone to a wireless telephone system. But, this device does not attempt to integrate and conceal it within the residence or provide an external concealed antenna. Unlike these devices, multiple telephone lines may be wired within structure of the residence lines, converted to wireless telephone signals, combined, and fed to a single antenna. By concealing the antenna within the exterior elements of a home, condominium, townhouse, or other residential structure, a complete subsystem is designed to link the interior of the home to an exterior cell. This antenna-transceiver subsystem is referred to as a wireless residential converter (WRC).

The WRC can be used to provide complete residential telephone service or provide a low-cost means of augmenting existing services. Like a conventional wireline system, multiple users may share a conversation using several ordinary wireline phones connected to a common two-wire circuit. Maintaining traditional simplicity, many inexpensive phones may be distributed throughout the residence for easy access and convenience without remembering to carry them or attach them to one's person. Recharging of the wired phones or the system is not required. But, common, rechargeable portables may also be used to roam within the home. Additional provisions in the system can be added to automatically obtain utility consumption information for consolidated billing purposes. When wide-band CDMA systems and transceiver ASIC's become available, potential service enhancements include full-motion video for teleconferencing and high-speed (2 MB/sec) modem service.

Figure 1B:
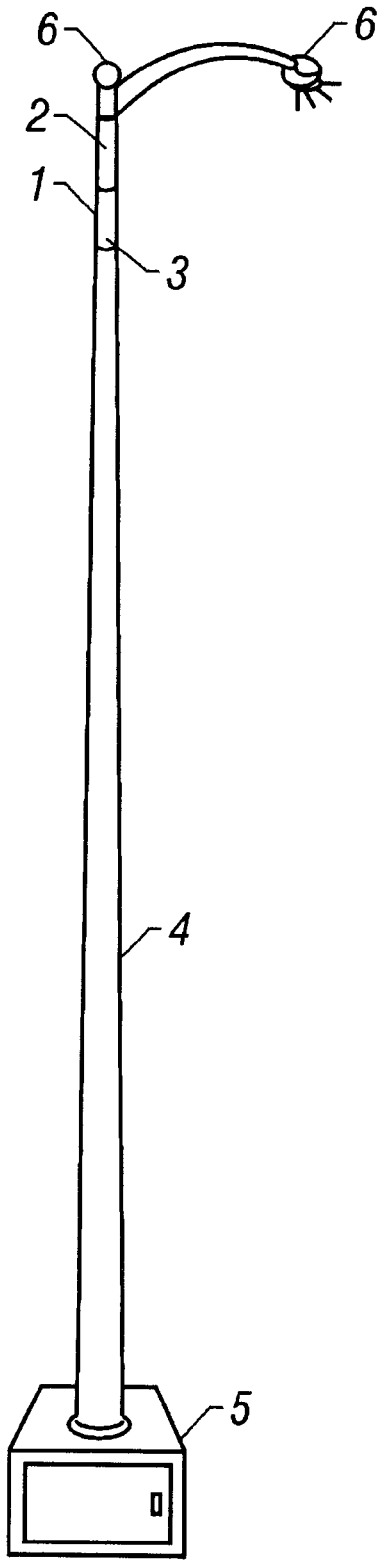
Figures 1, 12A:
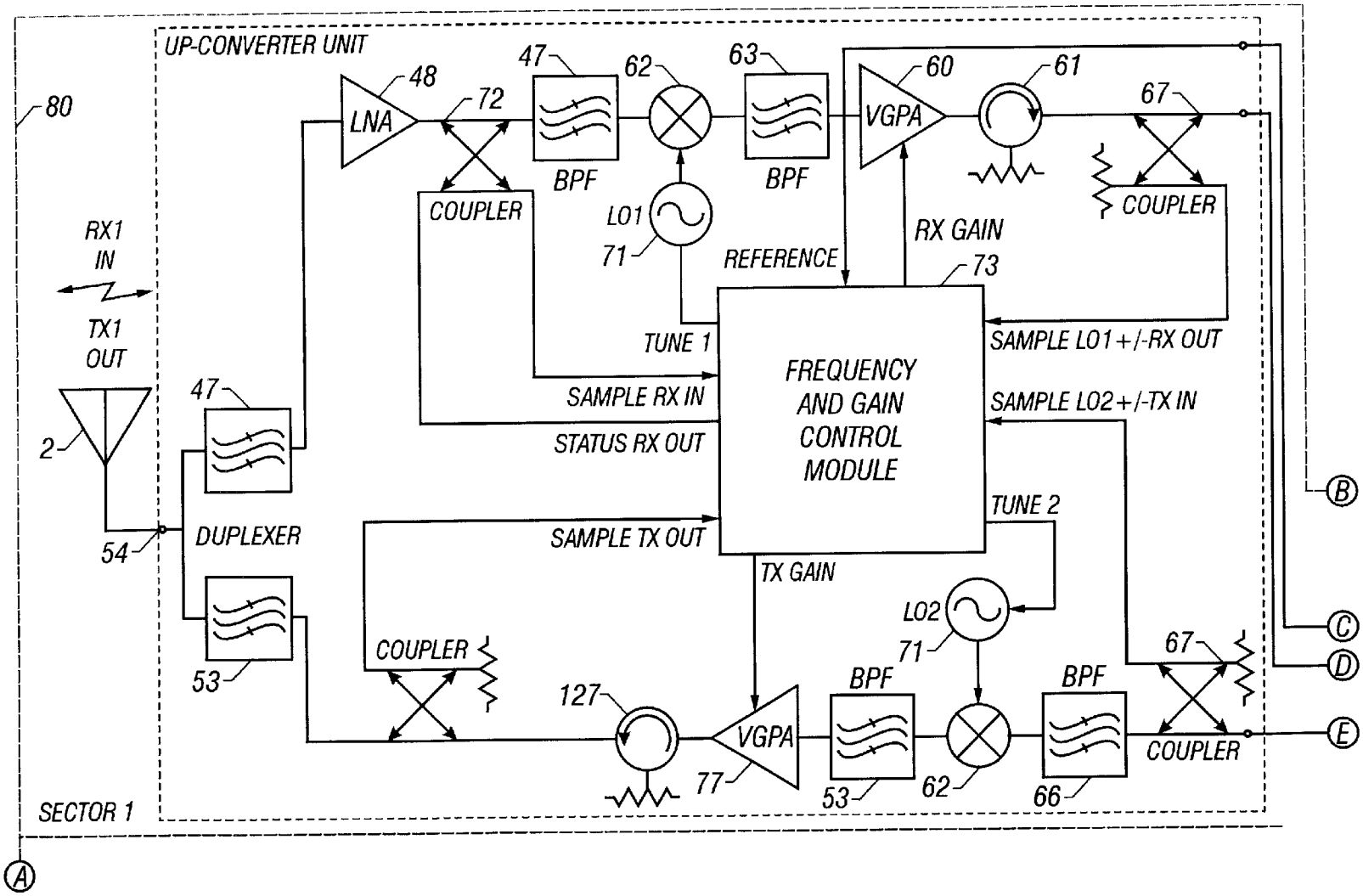
FIGS. 12A–12B are schematic illustrations of antenna-repeater nodes that are distributed throughout an urban area to provide RF coverage.
Figures 2, 12A:
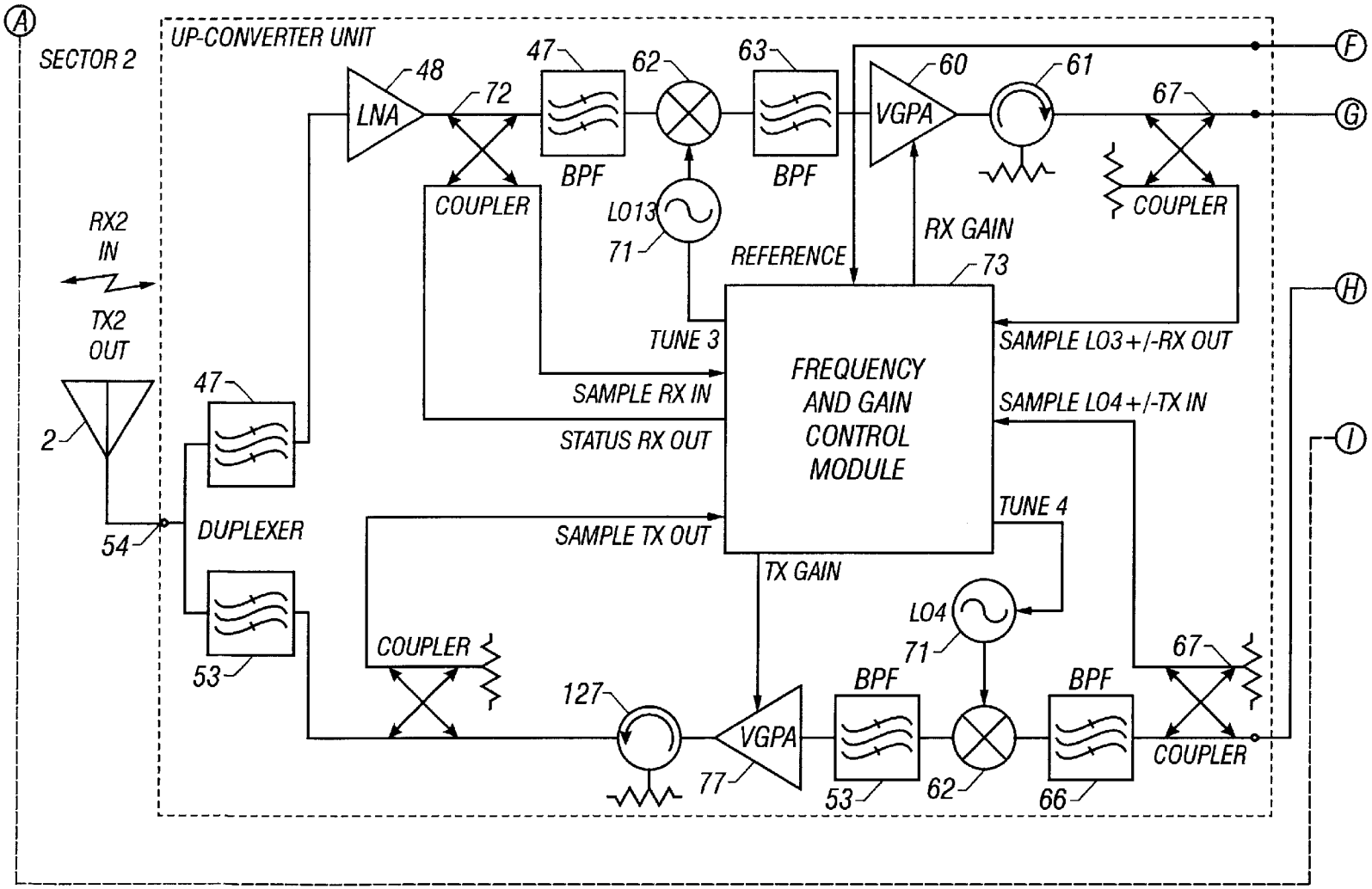
Figures 3, 12A:
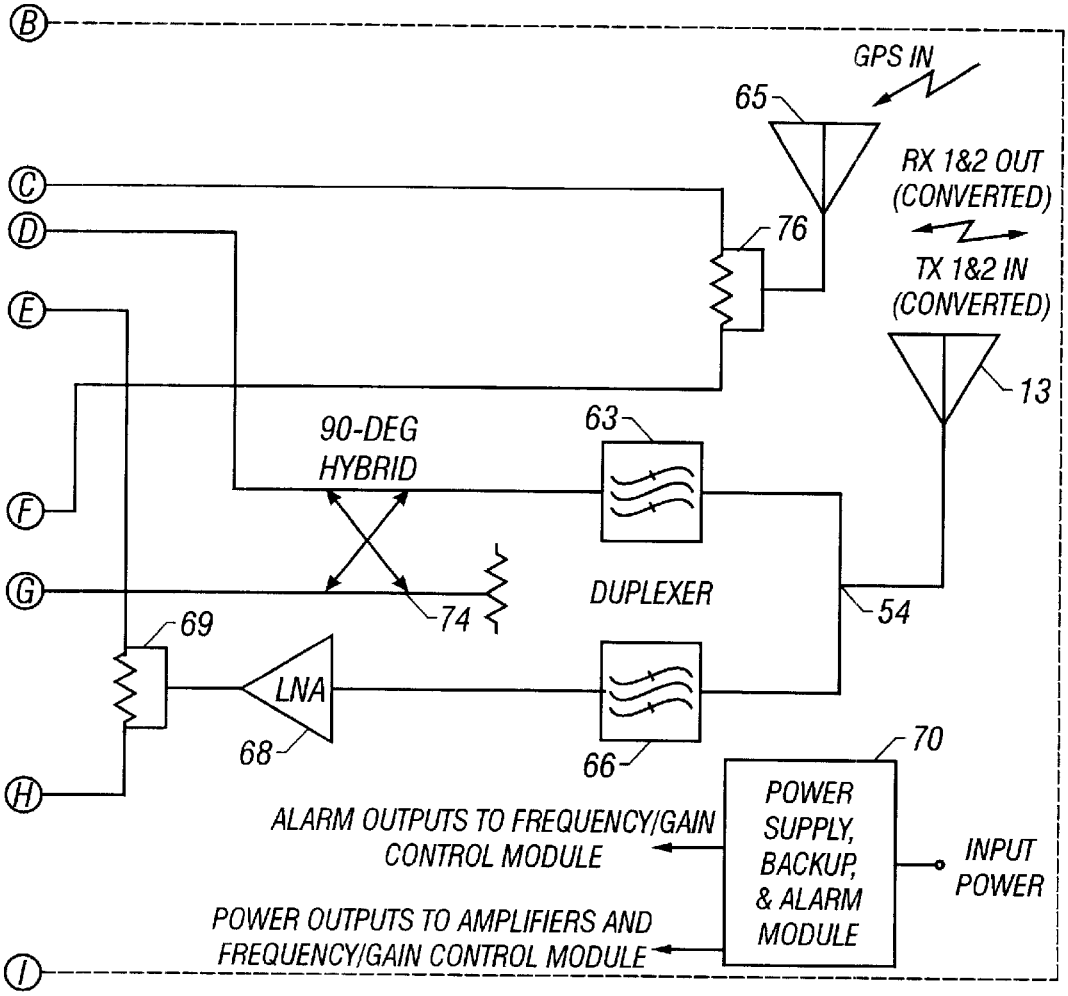

FIGS. 1A and 1B are front elevation views of a flag and a lamp post, respectively, in which concealed antennas, antenna-repeaters, antenna subsystems, and miniature base stations for picocells have been implemented in accordance with the teachings of the present invention. The present invention conceals and integrates antennas and related components into common, pole-like structures such as street lamps and flagpoles as seen in FIG. 1. A dielectric sleeve 1 slides over the antenna arrays to provide a protective sheath or radome and create the appearance of a pole. The sleeve may be continuous or divided into individual sections. The sections that are not covering the antenna elements may be made of metal or other materials. The sleeve is dyed or painted as necessary to prevent damage from environmental hazards such as UV radiation and weather.

Sections 2 and 3 of FIGS. 1A–1B at the upper end of the pole illustrate that the pole may be partitioned for locating or stacking multiple antenna arrays within the flagpole. The stacked antenna arrays may individually or simultaneously accommodate transmission (TX) and reception (RX) or different frequency bands and communications systems. The number of stacked arrays or other antenna configurations can be greater than two.

While maintaining the appearance of the pole-like structure, the shaft 4 or body of FIG. 1 encloses the supporting structure for the antenna arrays and related components such as cables, filters, amplifiers and other repeater or base station components. Alternatively, the shaft may provide the supporting structure as well.

A pedestal 5 at the base of the pole-like antennas in FIG. 1 can be used to house a frequency converter for a repeater, power supplies, battery backups, control circuitry, alarm circuitry, local oscillators, etc. In some cases, the pedestal and, if needed, additional space submerged below or nearby could house the equipment needed to package an entire base station or picocell using the pole-like antenna.

If the pole-like antenna structures of FIGS. 1A–1B are to be used as repeaters, frequency conversion components and circuitry may be housed below the primary antennas within the lower sections 4 and 5 of the pole and routed via coaxial cable or circular waveguide back up the shaft 4 coupled to a small, mechanically steerable dish or horn antenna underneath a spherical radome 6 for bi-directional transmission to the base station or even another repeater. This antenna 13 and radome 6 can be alternatively located above the lamp as shown in FIG. 1B. Alternately, the signals from the primary antennas can be routed up the shaft to a frequency converter at the top of the pole just below the steerable dish or horn antenna 13 and radome 6 but above the top antenna arrays 2 and 3.

Figure 2:
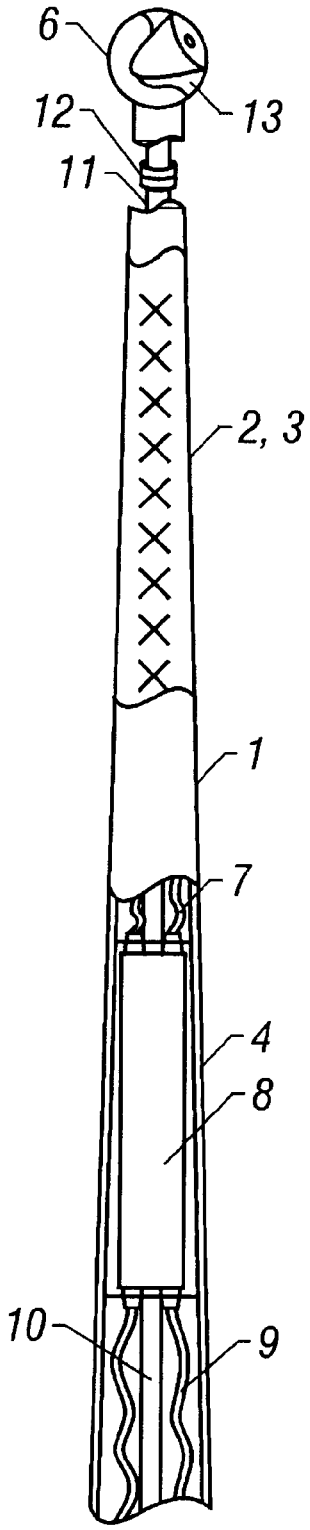
FIG. 2 is a cut-away view of the upper section of the flagpole of FIG. 1A illustrating the internal antennas and related components concealed therein.

FIG. 2 is a cut-away view of the upper section of the flagpole of FIG. 1A illustrating the internal antennas and related components concealed therein. Behind the dielectric sleeve or radome, the upper section of the pole conceals the antenna arrays 2 and 3. (Dual-slant arrays for one sector are illustrated for simplicity.) The antenna arrays are connected via coaxial cables 7 or other transmission lines to related subsystems components that may be housed in one or more integrated assemblies 8. Additional cables 9 connect the integrated assemblies 8 to connectors or additional subsystems at the base of the pole. The cables 7 and 9 and the integrated assembly 8 are concealed behind the shaft 4 of the pole and attached to the internal support 10 for the structure.

For a repeater or other application, FIG. 2 shows a circular waveguide tube 11 that is routed from a frequency converter or picocell subsystem in the shaft 4 or base 5 through the hollow support structure 10 to a rotary joint 12. The rotary joint is connected to the feed of a steerable dish or horn antenna 13. The dish or horn antenna 13 is protected and concealed inside a spherical radome 6 to resemble a ball. If the other end of the link is not stationary (such as a low-earth-orbiting (LEO) satellite), the rotary joint 12 may be augmented with a positioner and control circuitry for tracking. Alternatively, the frequecy converter could be located just below the rotary joint 12 to minimize signal path losses.

FIGS. 3A–3E are perspective views of various curtain-wall systems that are commonly used in the construction of high-rise buildings. There are five basic curtain-wall systems that are used in the construction of steel-framed, high-rise buildings or skyscrapers. The stick system (FIG. 3A) consists of seven basic elements: anchors 14, mullion 15, spandrel panels 16, horizontal rails 17, vision glass 18, and interior mullion trim 19. Of these, the spandrel panel 16 and mullion 15 are suitable media for concealing flat-panel antenna arrays and pole-like antenna subsystems, respectively. The interior mullion trim 19 can enclose an antenna and be especially useful in an interior microcell application or wireless local-area-network (WLAN) system. The unit system (FIG. 3B) consists of an anchor 14 and a pre-assembled frame unit 20 that could conceal antennas in the same manner as the mullion 15, the spandrel panel 16, and the interior mullion trim 19. The unit-and-mullion system (FIG. 3C) features a different installation for the preassembled frame unit 20 with a separate interior mullion trim 19 and one- to two-story length mullions 15. The panel system (FIG. 3D) uses a single panel section 21 that can conceal antenna arrays and related components in the same manner as the spandrel panel 16 or preassembled frame unit 20. The column cover and spandrel system (FIG. 3E) offers the best opportunity to illustrate concealment of antennas and related components within a column cover section 22 and a spandrel panel 16. Antennas can also be concealed in interior wall panels and ceiling tiles.

Figure 3B:
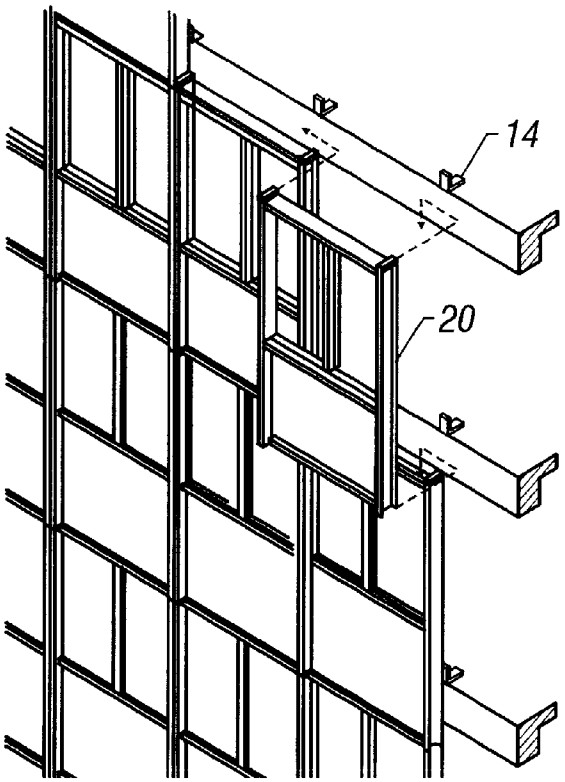
FIGS. 3A–3E are perspective views of various curtain-wall systems that are commonly used in the construction of high-rise buildings.
Figure 3A:
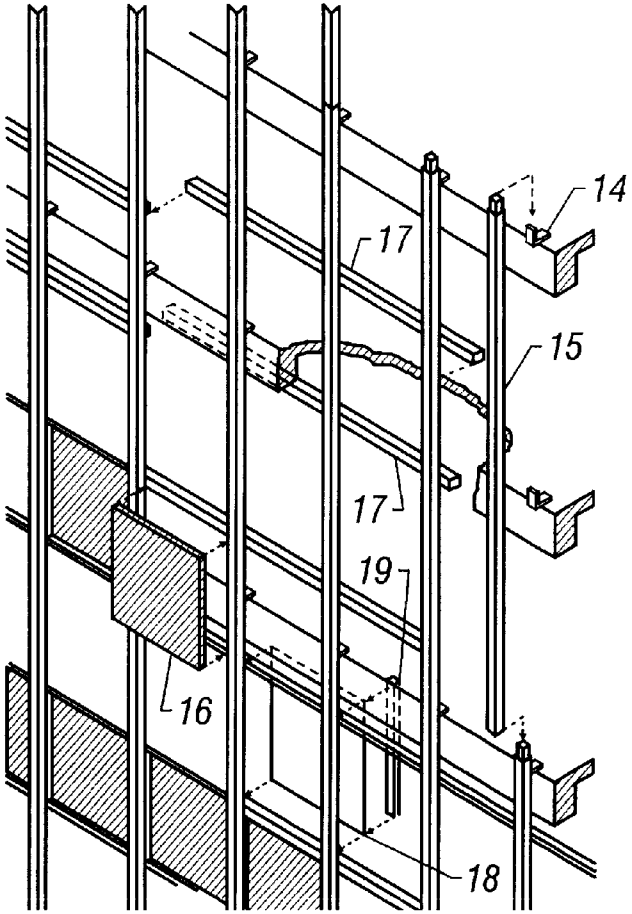
Figure 3D:
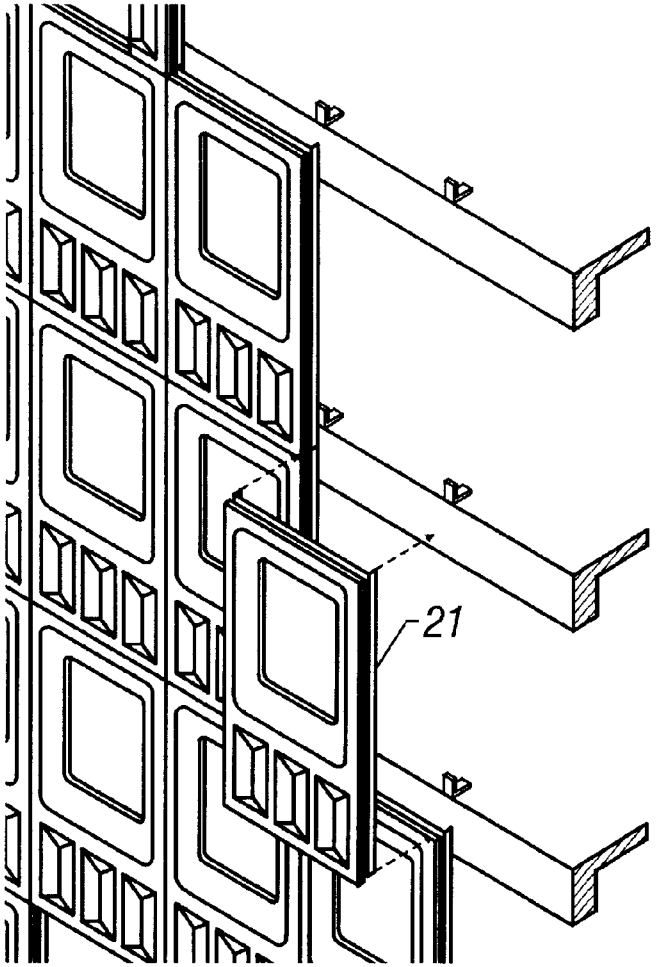
Figure 3C:
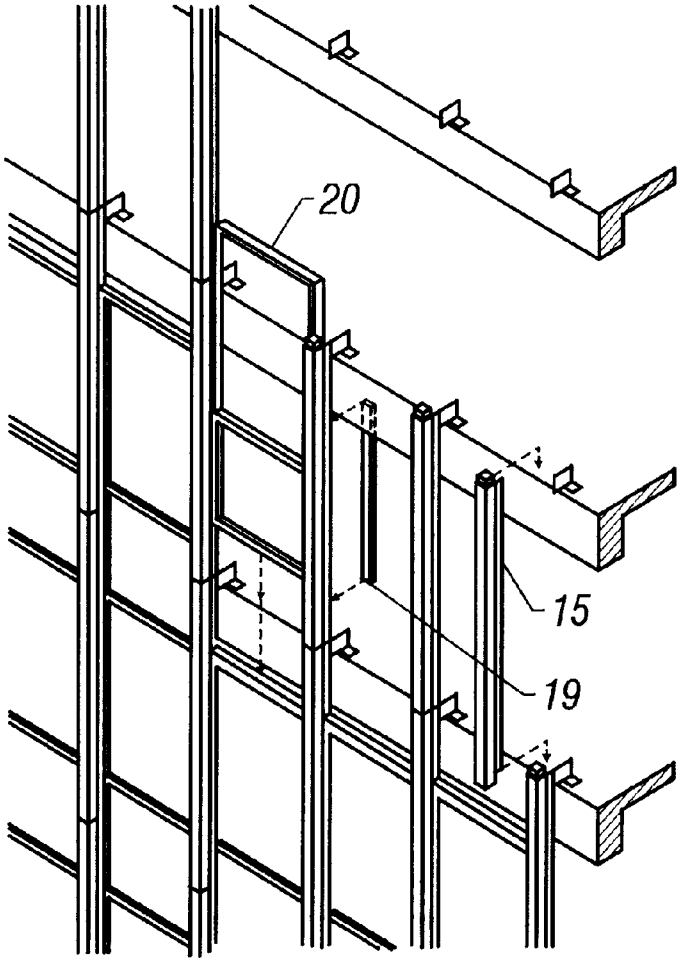
Figure 3E:
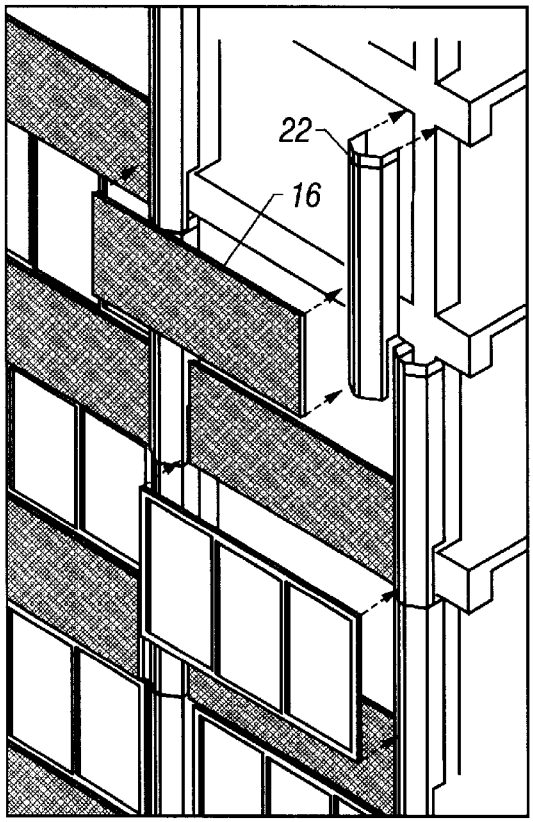
Figure 4A:
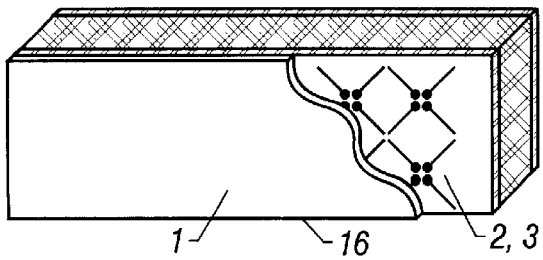
FIGS. 4A–4B are cut-away views of the spandrel panel and column cover section of FIGS. 3A and 3E, respectively, illustrating the antenna and related components concealed therein.
Figure 4B:
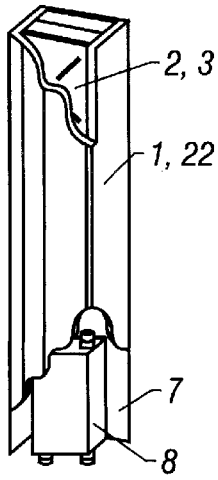

FIGS. 4A–4B are cut-away views of the spandrel panel 16 and column cover section 22 of FIGS. 3A and 3E, respectively, illustrating the antennas and related components concealed therein. The spandrel panel 16 can conceal antenna arrays 2 and 3 and related components as shown in FIG. 4A. In FIG. 4B, the column cover section 22 forms a dielectric radome 1 to conceal antenna arrays and related components as shown in a manner similar to that of FIG. 2. Other sections can function as conduit to conceal the routing of cables.

Figure 5A:
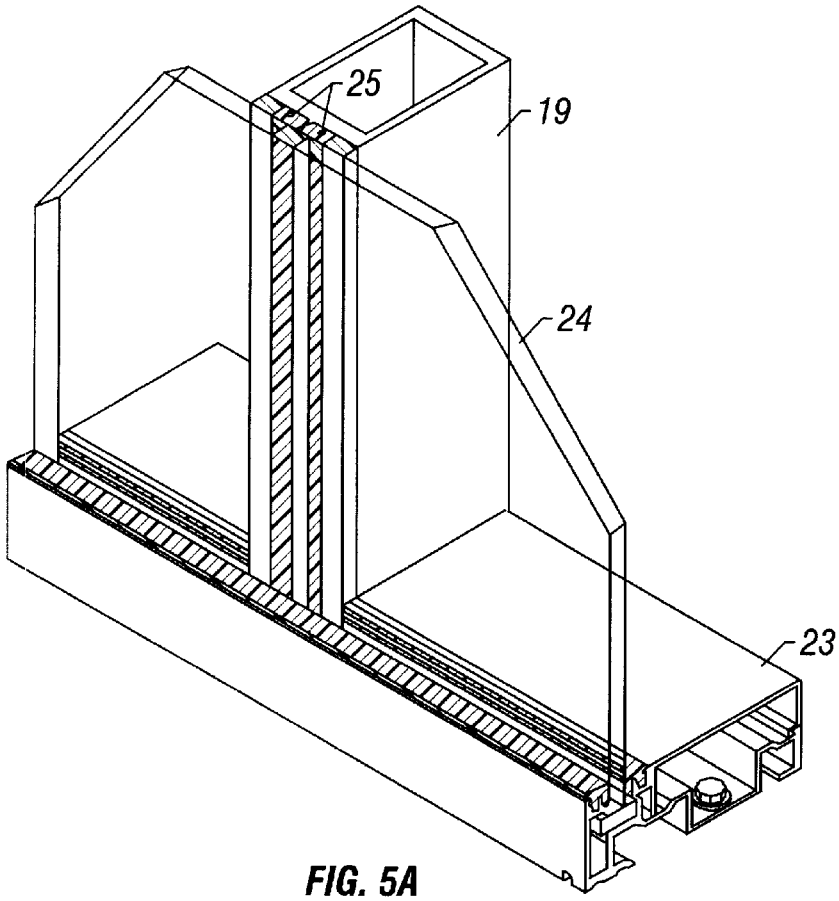
FIGS. 5A–5B are perspective views of typical window constructions for a curtain-wall system in which antennas and related components may be concealed in accordance with the teachings of the present invention.
Figure 5B:
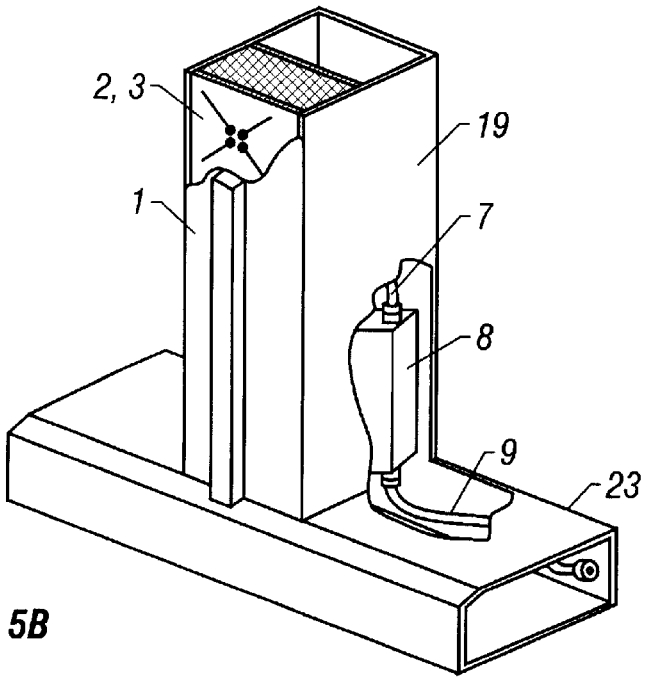
Figure 6A:
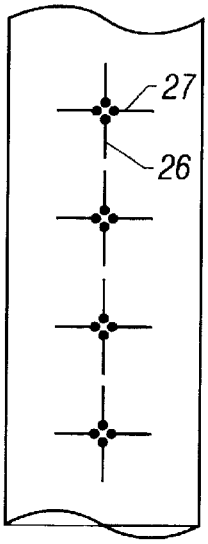
FIGS. 6A–6F illustrate examples of alternative arrangements of antenna elements to form arrays that are concealed within narrow vertical structures such as poles or narrow curtain-wall or strip window elements such as mullions and column cover sections.
Figure 6B:
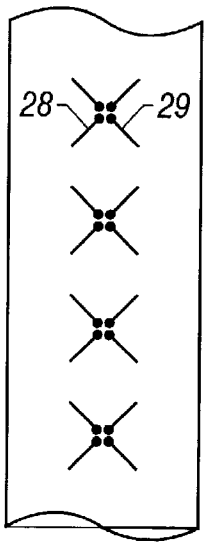
Figure 6C:
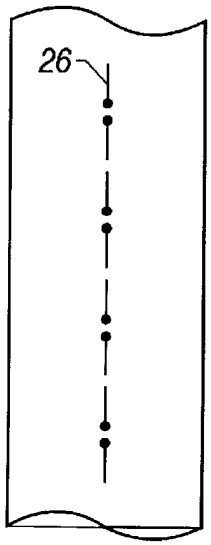
Figure 6D:
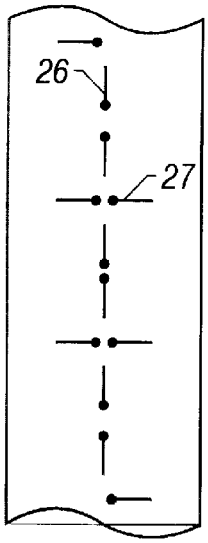
Figure 6E:
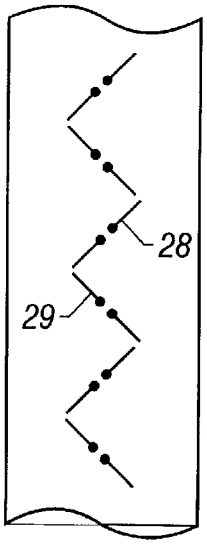
Figure 6F:
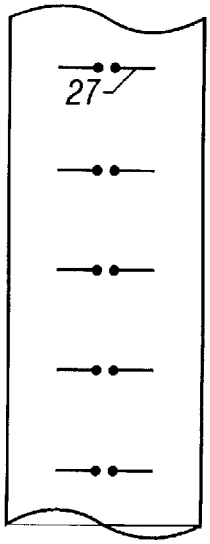

A cutaway portion of a preassembled frame unit that supports a window glass or glazing is shown in FIG. 5A. The interior mullion trim 19 is a hollow, extruded aluminum feature of sufficient height and width and depth to conceal the antenna elements 2 and 3 as depicted in FIG. 5B. The radome 1 may be designed to eliminate the spacers 25 and position the two panes 24. Alternatively, the mullion orientation can be reversed so that the antenna beam points into the building in interior applications such a WLAN's or interior microcells. Other components, particularly cables 7 and 9 and integrated assemblies 8, may be concealed underneath the interior mullion trim 19 or the snap-on aluminum sill cover 23. A repeater for an interior microcell system or to an external base station may be packaged within the sill cover 23. The sill cover 23 may also be used to house horizontal arrays if required by the application.

FIGS. 6A–6F illustrate examples of alternative arrangements of antenna elements to form arrays that are concealed within narrow vertical structures such as poles or narrow curtain-wall or strip window elements such as mullions and column cover sections. For both pole-like and panel-like configurations, the present invention can accomplish the desired concealment by arranging and combining antenna elements, typically vertical 26, horizontal 27, −45 degree slant 28, or +45 degree slant 29 dipoles. Many dipole elements may be combined to form vertically (FIG. 6C), horizontally (FIG. 6F), both vertically and horizontally (FIGS. 6A and 6D), or +45 degree and −45 degree slant (FIGS. 6B and 6E) polarized arrays of radiating elements that can be directional or omnidirectional.

Diversity, particularly in the uplink (receiving from a mobile unit), mode is a common requirement and requires two or more antennas but not necessarily twice their surface area. Given and maintaining their inherent isolation, orthogonally polarized combinations of arrays are mounted in close proximity or even interlaced (see FIGS. 6A and 6B) to locate two antennas in the same geometric space to reduce the total frontal area. Other dual-slant (+45 and −45 degree), horizontal and vertical, or other orthogonal arrangements are possible to achieve the desired gain and pattern characteristics.

Figure 7A:
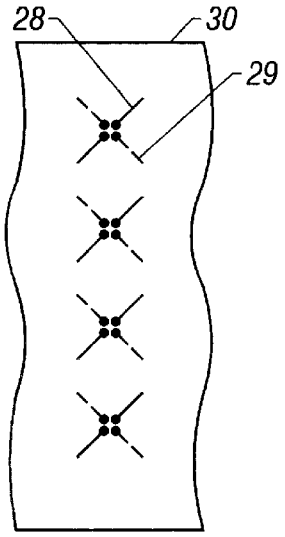
FIGS. 7A–7E illustrate alternative array configurations for a panel (FIGS. 7A and 7D) or pole (FIGS. 7B and 7E) as well as a centerline cross-sectional view (FIG. 7C) taken along line 7C—7C of FIG. 7B.
Figure 7B:
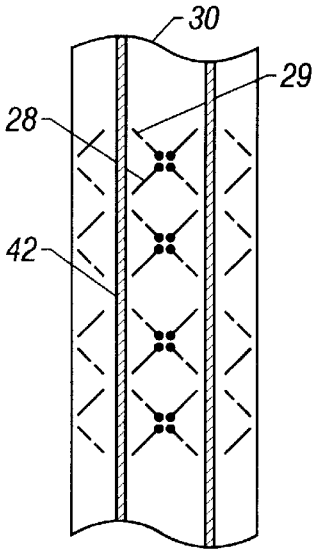

FIGS. 7A–7E illustrate alternative array configurations for a panel (FIGS. 7A and 7D) or pole (FIGS. 7B and 7E) as well as a centerline cross-sectional view (FIG. 7C) taken along line 7C—7C of FIG. 7B. The individual antenna arrays are fabricated using multilayer, printed-circuit techniques to reduce manufacturing costs (primarily assembly labor) and to eliminate interconnections between the antenna elements and the beamforming networks. In fact, a variety of dielectric materials can be integrated to form the radome, to reduce the physical dimensions of the antenna via dielectric loading, to provide impedance matching between the air and the antenna, and to desirably alter the pattern characteristics of the antenna.

For any method of implementing the arrays of radiating elements, aperture gain and patterns are tailored by introducing amplitude weightings and phase offsets in the beamforming (combining) networks using techniques well known by those skilled in the art. The beamforming networks may be constructed using any form of transmission line but are typically made from coaxial cable, microstripline, or stripline. The latter two beamforming networks are fabricated using printed-circuit techniques and readily lend themselves to integration with an aperture-coupled patch or other microstrip-based realization for the radiating elements.

In FIG. 7, dual-slant arrays 28 and 29 of antenna elements are depicted to illustrate two methods of physical construction for any of the above array configurations. Elements are implemented using printed-circuit configurations such as aperture-coupled patches for panel-like configurations in FIG. 7A and pole-like configurations in FIG. 7B (3-sector illustration shown) with a center-line, cross-sectional view in FIG. 7C. Solid and dashed lines are used to illustrate that dipole radiating elements 28 and 29 for each collocated, orthogonal array may optionally be etched on opposite sides 32 and 33 of a thin dielectric supporting material 30 to facilitate connections in other connecting or coupling schemes.

Figure 7C:
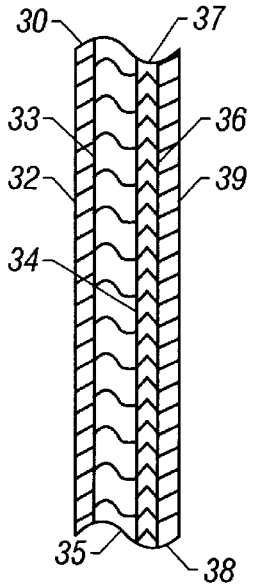

Other elements of an aperture-coupled patch configuration are represented in the cross-sectional view of FIG. 7C. The elements 28 and 29 are implemented by etching narrow rectangular patches from the metal cladding of layers 32 and 33 that are supported by a thin dielectric 30 and separated from the ground plane of the antenna 34 by a supporting dielectric or air layer 35. Slots or apertures in the ground plane 34 allow energy to couple from the microstrip feed circuitry 36 that is etched onto the side of the supporting dielectric 37 which is opposite the ground plane 34. Alternatively, another dielectric layer 38 and ground plane 39 can be added to form a stripline structure and reduce the size of circuitry, such as directional couplers, that may be integrated into the feed. However, a microstrip structure must be maintained in the immediate area of the aperture-coupled feed.

As an alternative embodiment of panel-like (FIG. 7D) and pole-like configurations (FIG. 7E), radiating elements are implemented using other rectangular patch techniques that are common to currently available panel antennas. Each pair of dipole radiating elements for both polarizations may be implemented using a single, etched, square or rectangular patch 40 of metal cladding at location 32 or 33 in FIG. 7C, which still applies. In this case the crossed dipoles 28 and 29, both dashed lines, represent only the orientation of the resonant microstrip feed elements on layer 36 and ground plane 34 apertures. Typically, the dipole elements consisting of rectangular patches 40 that are etched from the metal cladding in the position 33. Therefore, layers 30 and 32 have been omitted in FIGS. 7D and 7E to show the rectangular patches 40.

Figure 7D:
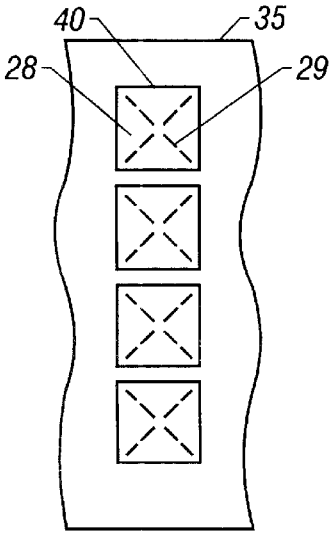
Figure 7E:
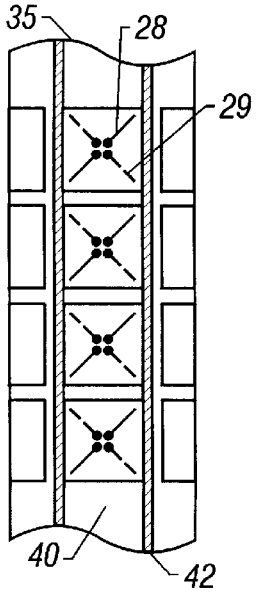

When used in conjunction with FIGS. 7D and 7E, the first dielectric layer 30 in FIG. 7C may represent a dielectric load or lens that can also serve as the radome. In this case, layer 33 in FIG. 7C represents the paint or other protective coat that protects the radome from the weather and UV radiation. In the conventional manner, an air gap may replace layers 30 and 33 in FIG. 7C and separates the rectangular patches in position 33 from an external dielectric sleeve that forms the radome 1 (not shown). However, implementing a dielectric lens that is ideally fashioned from another dielectric layer 30 or the radome interior cross-section and laminated directly onto the face of a printed circuit realization of the array elements allows for some reduction in the element size and an additional means of beamwidth adjustment.

Figure 8A:
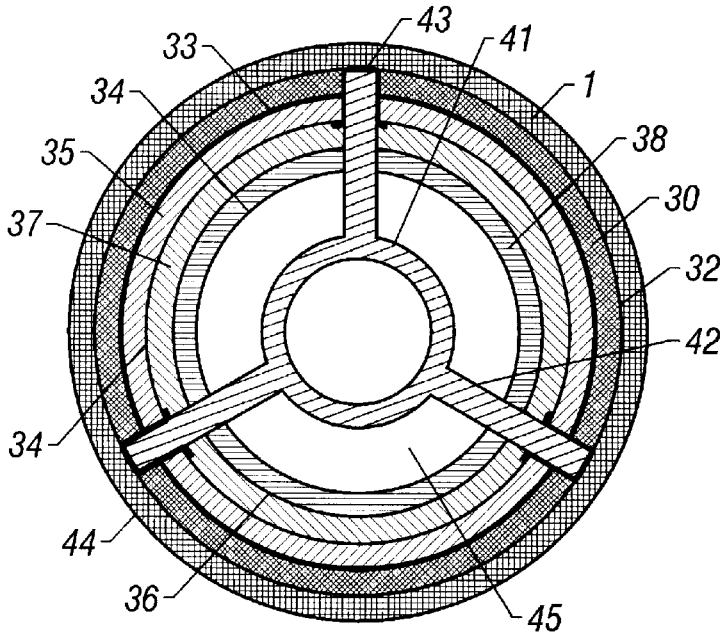
FIGS. 8A–8B are top, cross-sectional views of alternative embodiments of antenna arrays packaged within a pole-like object in a three-sector arrangement.
Figure 8B:
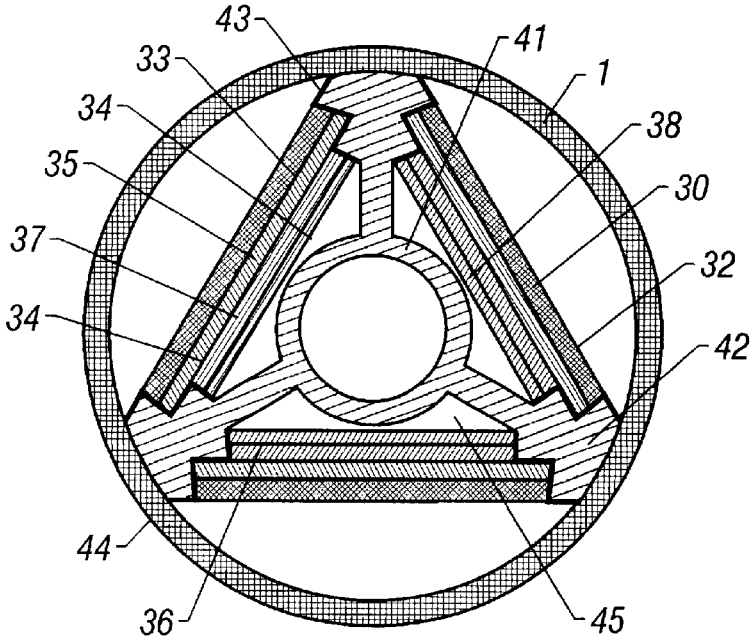

FIGS. 8A–8B are top, cross-sectional views of alternative embodiments of antenna arrays packaged within a pole-like object in a three-sector arrangement such as those illustrated in FIGS. 7B and FIG. 7D, respectively. Although a three-sector arrangement is shown, one to four sectors (or more) can be similarly implemented if the pole is of sufficient diameter.

In FIGS. 8A and 8B, the core or backbone 41 of the pole-like antenna may be extruded, cast, or molded from metal to provide the supporting structure as well as the antenna ground plane, dividers 42 for sectored arrangements, and grounded 'wings' 43 to be used as reflectors or, simply, to provide a ground path between certain layers of the feed structure. However, fabrication of the core from a light-weight material such as carbon fiber offers advantages. By making the core from an insulating material, the spokes or radial-features 42 will be less likely to adversely affect the antenna characteristics or patterns. Conversely, metal plating of the spokes in FIG. 8 will introduce reflectors or 'wings' 43 that tailor the patterns when connected to the ground plane. An individual ground plane 43 can be provided for each antenna array to tailor the antenna performance.

In FIG. 8, the outer shell is the radome 1 that is fabricated from a low-loss dielectric and painted with an appropriate coating 44 for environmental protection. The other layers of FIG. 8 are consistent with that of FIG. 7C. Cavities 45 are provided for routing interconnecting cables or wiring. The cavity that is inside of the core is hollow and may be used to route cables or circular waveguide for very high frequency signals to the dish or horn antenna 13 of a repeater. FIG. 8A depicts a radial, conformal installation of the various layers of the concealed antenna that is used to reduce the diameter of the antenna. Although, for a given frequency band, the arrangement in FIG. 8A is slightly larger in diameter than the arrangement in 8A, the flat installation of the various layers of the concealed antenna is somewhat less expensive to fabricate.

The pole-like structures can support additional components that are associated with antennas to form integrated subsystems such as filter-amplifier combinations, commonly referred to as tower-mounted amplifiers (TMA's), or a frequency converter as described below. Using printed circuit techniques, the same printed circuit assemblies may be used to fabricate many of the associated components including filters and duplexers, 90-degree-hybrid couplers for circular polarization, directional couplers for sampling and VSWR monitoring power dividers, and others. Portions of other components including bias tees and preamplifiers may be integrated into these printed circuit assemblies. However, losses and power-handling requirements may dictate component technologies that are best packaged individually or inside integrated assemblies 8 which may be concealed as previously shown. FIGS. 9A–9E illustrate common configurations for filter-amplifier subsystems that may be concealed within the concealed antenna systems.

FIGS. 9A–9E are schematic illustrations of filter-amplifier subsystems that are housed in microwave integrated circuit (MIC) assemblies within the concealed antenna structures to complement each antenna array. To reject out-of-band interference and improve sensitivity for the uplink, the arrays are optimally followed by an appropriate, low-insertion-loss preselector or bandpass filter (BPF) 47 with a DC short for lightning suppression, a low-noise preamplifier (LNA) 48, and a DC power injection device (a bias tee) 49 with a lightning arrestor 50. Given the desired noise, gain and other performance parameters, the preamplifier 48, while adding some noise to the system, will suppress the degradation in signal-to-noise ratio that is induced by the cable and the repeater device or the base station receiver. In case of amplifier failure, a bypass feature 51 consisting of switches and transmission line is often included. A redundant, low-noise amplifier 48 (not shown) is sometimes provided as part of the bypass scheme. Another BPF 47 can follow the LNA 48 to reduce harmonic or spurious outputs. Such a device is commonly known as a tower-mounted amplifier (TMA) because of its typical mounting configuration.

Figure 9A:
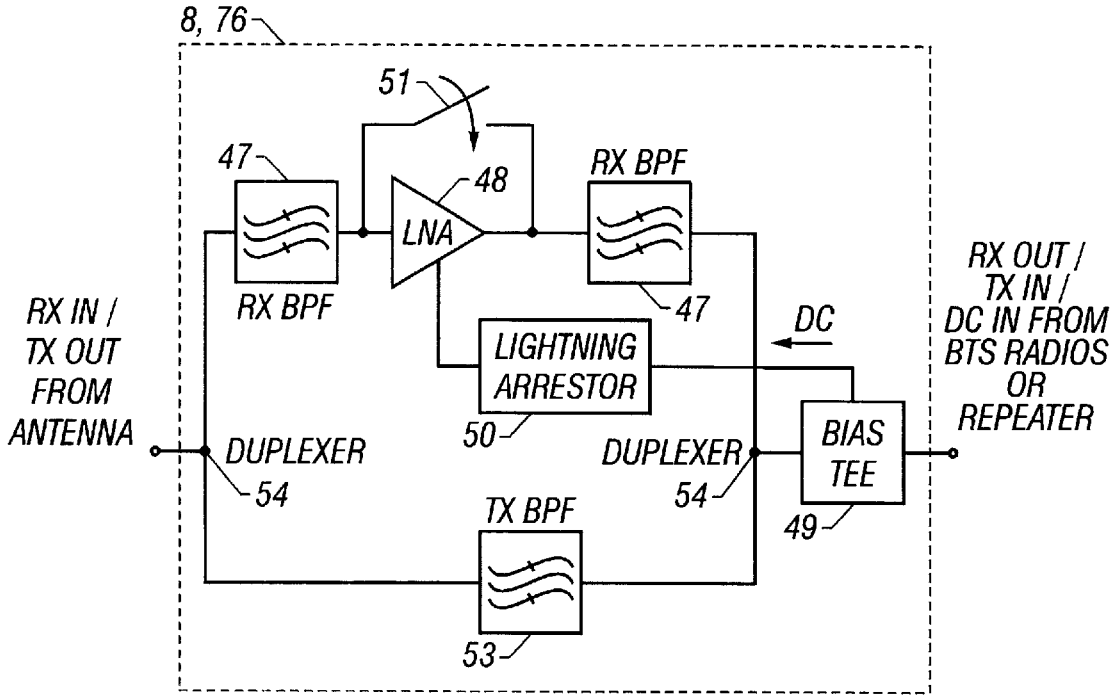
FIGS. 9A–9E are schematic illustrations of filter-amplifier subsystems that are housed in microwave integrated circuit (MIC) within the concealed antenna structures to complement each antenna array.
Figure 9B:
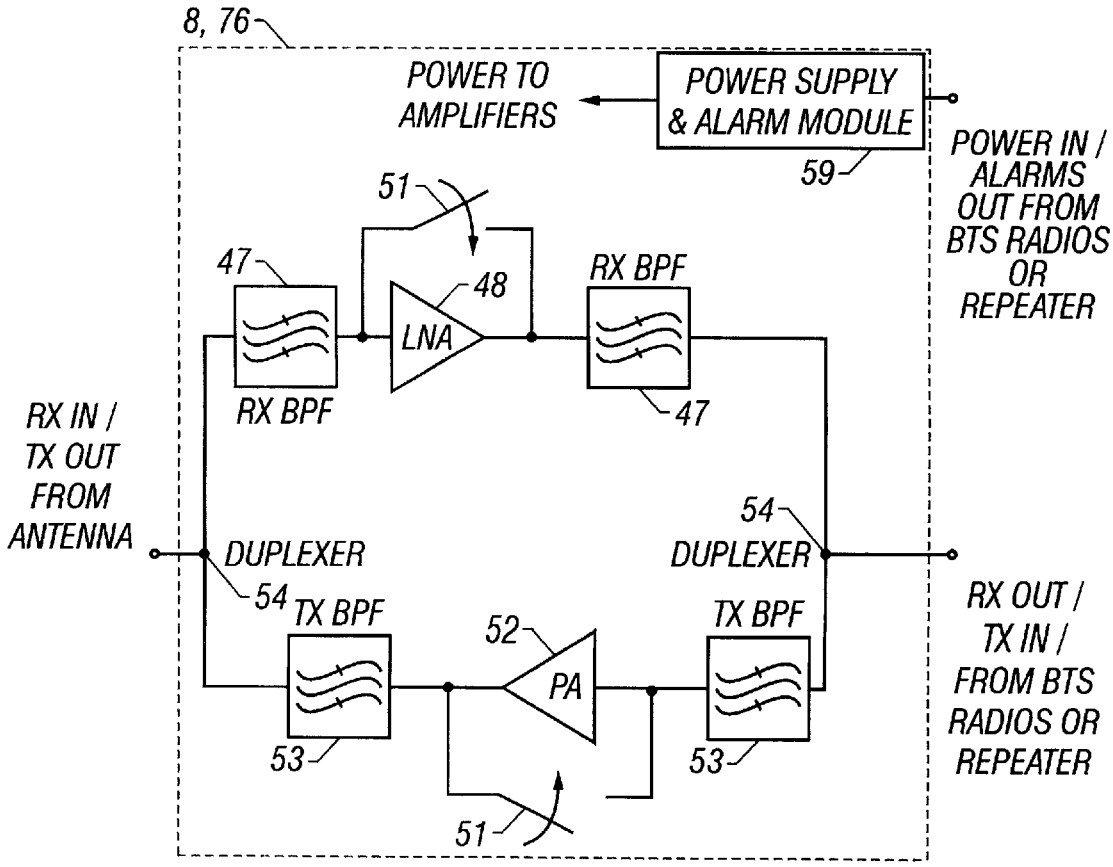
Figure 9C:
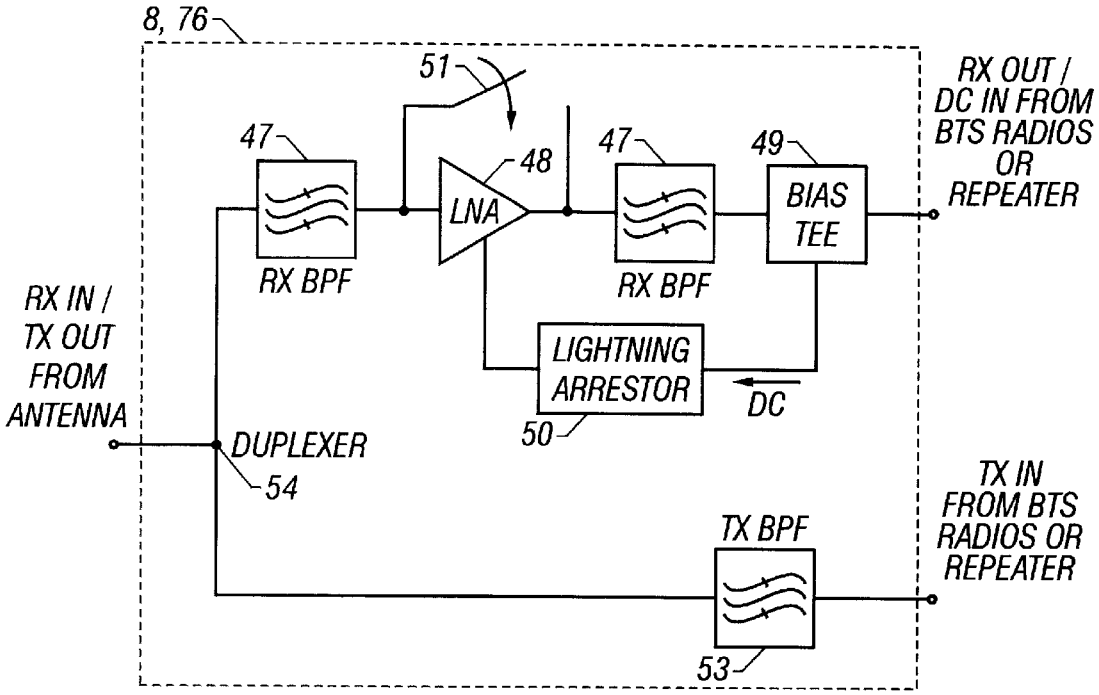
Figure 9D:
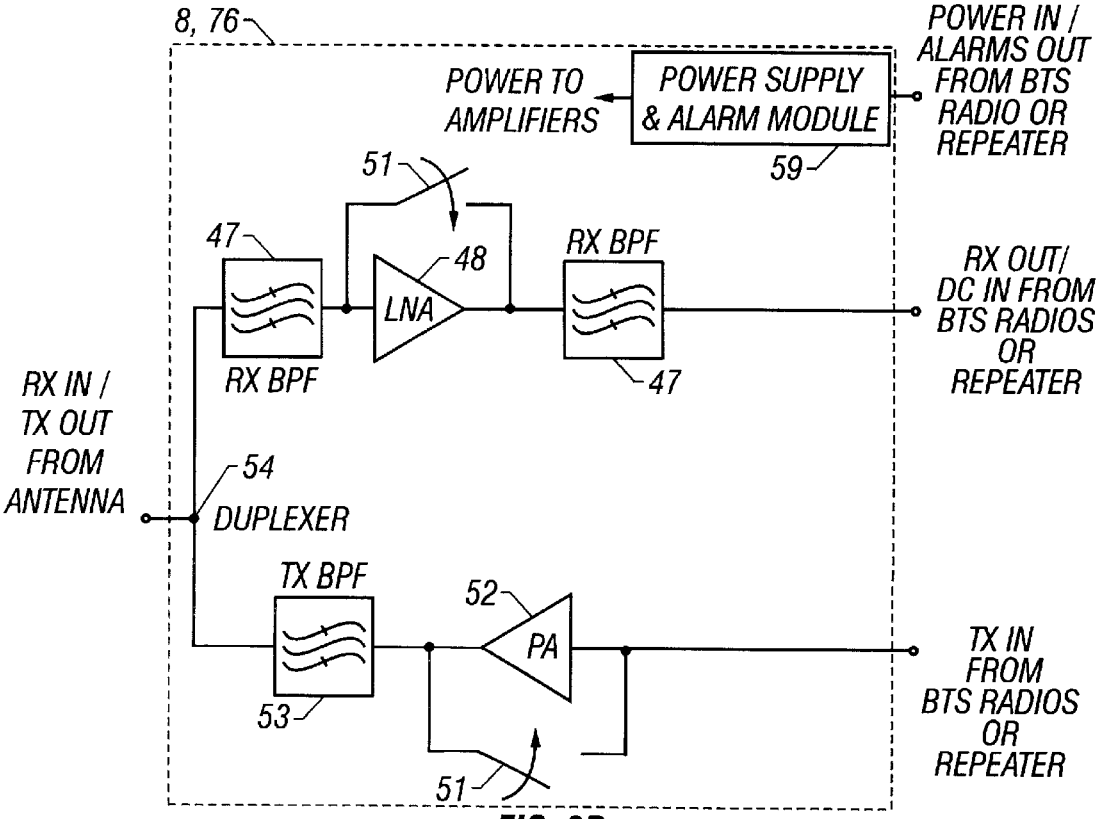
Figure 9E:
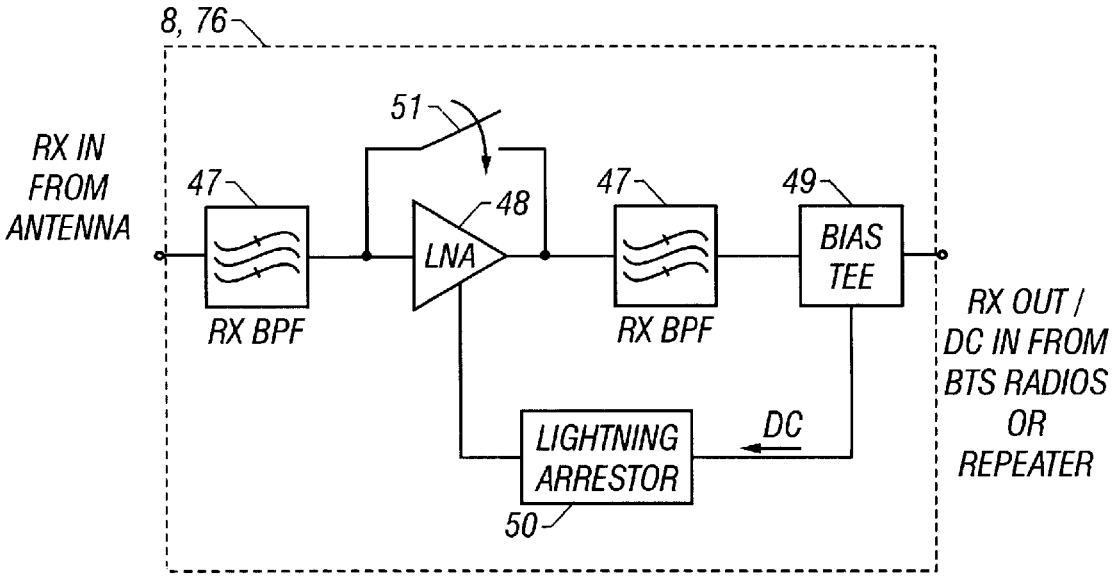

For simultaneous transmission using the same antenna array, these devices can be further integrated with transmitting filters 53 to form dual-(FIG. 9A) or single-(FIG. 9B) duplexed, filter-amplifier subsystems if the appropriate matching is provided at the junctions 54. A TX power or booster amplifier (PA) 52 is added, if needed, to insure that sufficient output power is available. The PA 52 may also have a bypass 51 feature. However, the bias tee 49 is usually omitted in these configurations (9B, 9D) because the alarm outputs and power inputs to the power amplifier 52 require additional wiring and an additional power supply and alarm module 59. This module 59 contains one or more DC-to-DC converters, alarm circuitry, and a lightning arrestor. These alternate configurations use the same antenna(s) for both transmitting and receiving. However, independent antennas can be used with separate receiving and transmission configurations that may only require receive-only TMA's as shown in FIG. 9E.

By including low-noise preamplification 48 with the appropriate filtering 47 that is physically close to the antenna with minimal interconnecting transmission lines or connectors, overall system sensitivity is maximized in the preferred embodiment. To reduce size, weight and cost, enhance performance, and facilitate testing, these subsystems may also be packaged into MIC assemblies 8 using a variety of filter technologies (combline, cavity, dielectric resonator, suspended-stripline, lumped-element, microstrip, or other), transmission-line interconnection technologies (microstrip, stripline, coaxial, trough line, slabline, or other), and amplifier technologies (discrete element, microwave integrated circuit (MIC), monolithic microwave integrated circuit (MMIC), or combinations thereof). Alternatively, one or more of the subsystem components may be fabricated individually using any appropriate technology, connected using coaxial cables or other transmission line media, and packaged within the body of the pole-like structure.

Circular polarization offers matched polarization for the common condition that results when the received or transmitted wave from the mobile unit is linked off-axis with respect to the base station or repeater. Using circular polarization, fading due to motion or variations in the position of the antenna on mobile unit could be reduced. However, since half of the signal power is lost in the 90-degree hybrid with no commensurate reduction in the noise, the signal-to-noise ratio for the passive implementation is also reduced by over half or 3 dB.

Figure 10A:
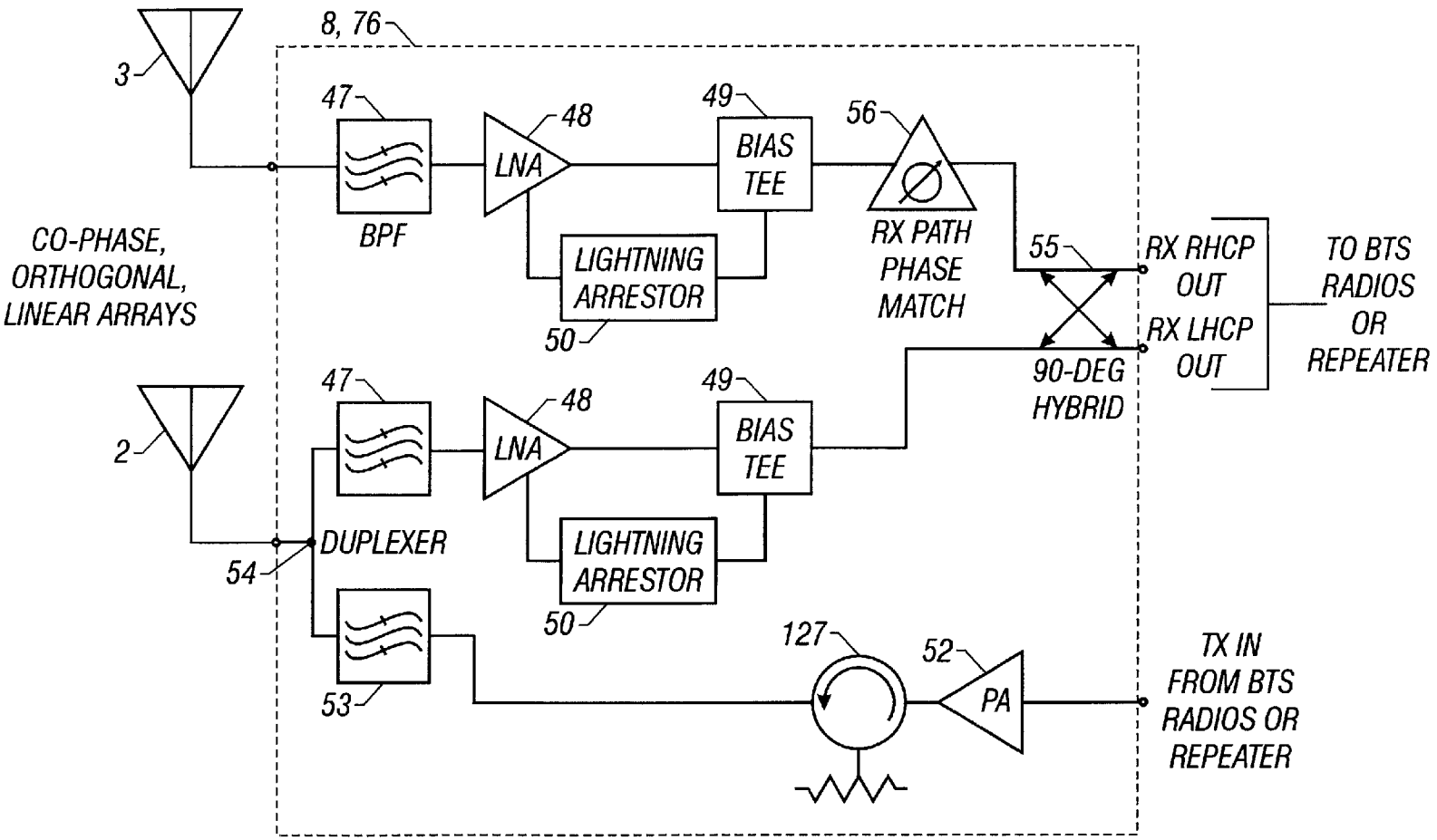
FIGS. 10A–10D are schematic illusions of orthogonal linear arrays and filter-amplifier subsystems that are combined with 90-degree, hybrid couplers to implement concealed circularly polarized antenna-filter-amplifier subsystems.
Figure 10B:
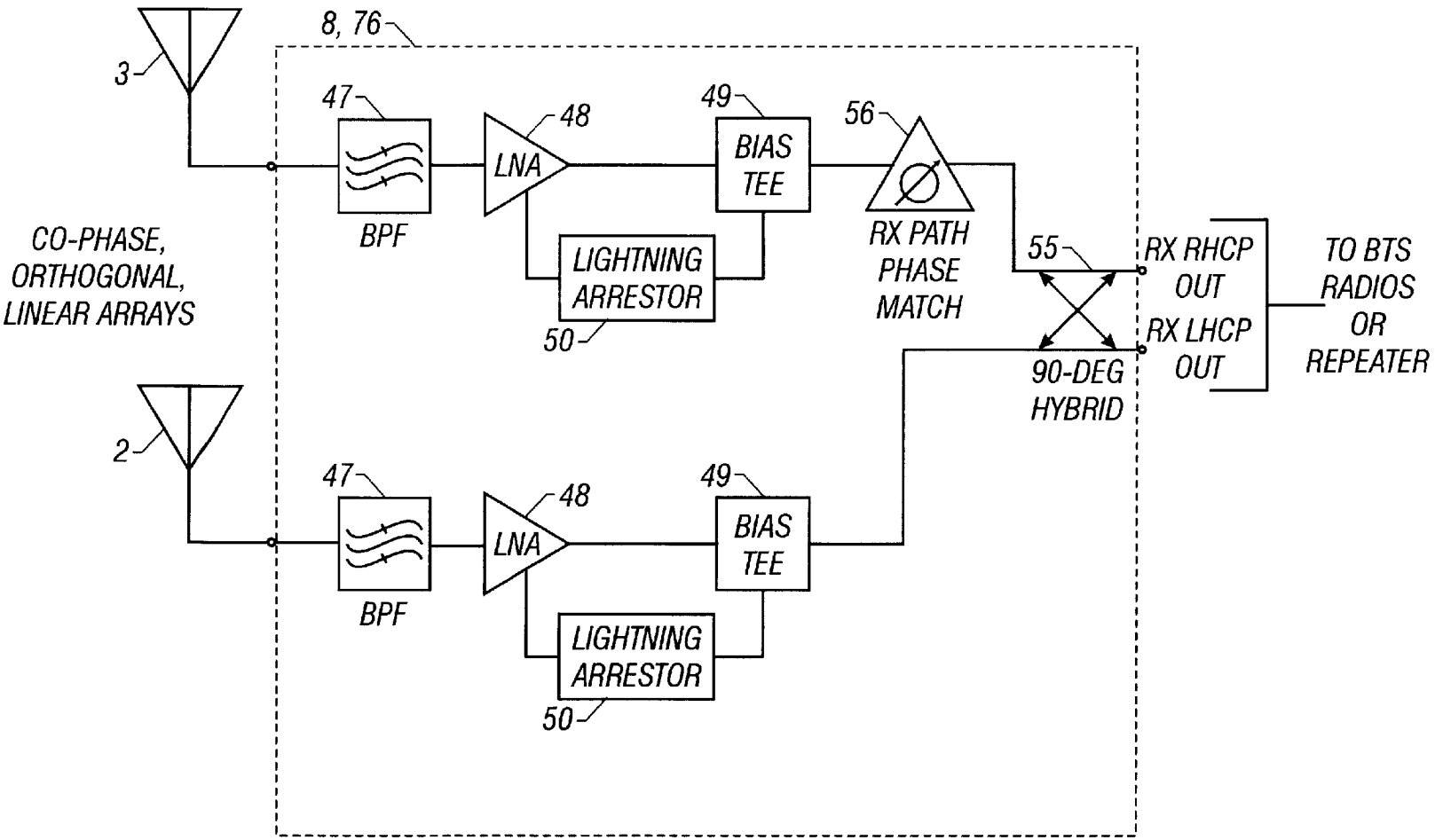

FIGS. 10A–10D are schematic illustrations of orthogonal linear arrays and filter-amplifier subsystems that are combined with 90-degree, hybrid couplers to implement concealed circularly polarized antenna-filter-amplifier subsystems. When the 90-degree hybrid 59 is inserted following phase-matched filtering 47 and low-noise preamplification 48 of both orthogonal, phase-matched polarizations, circular polarization may be accomplished without the resultant 3 dB loss in signal-to-noise ratio. A phase shifter 56 may be added to achieve the necessary phase match and account for component errors. However, components, including the antenna, are designed to inherently phase match. The preamplification 48 will add some noise to the system, but, as previously discussed, will more than suppress the signal-to-noise ratio degradation that is introduced by an interconnecting cable, the hybrid 55, and base station receiver or repeater subsystem. However, phase-matching of components following the hybrid is not required to maintain circular polarization. In FIG. 10A, only one, linear polarization is used for transmission while the uplink path is circularly polarized. In FIG. 10B, the uplink path is circularly polarized and the downlink is handled independently on a separate antenna.

Figure 10C:
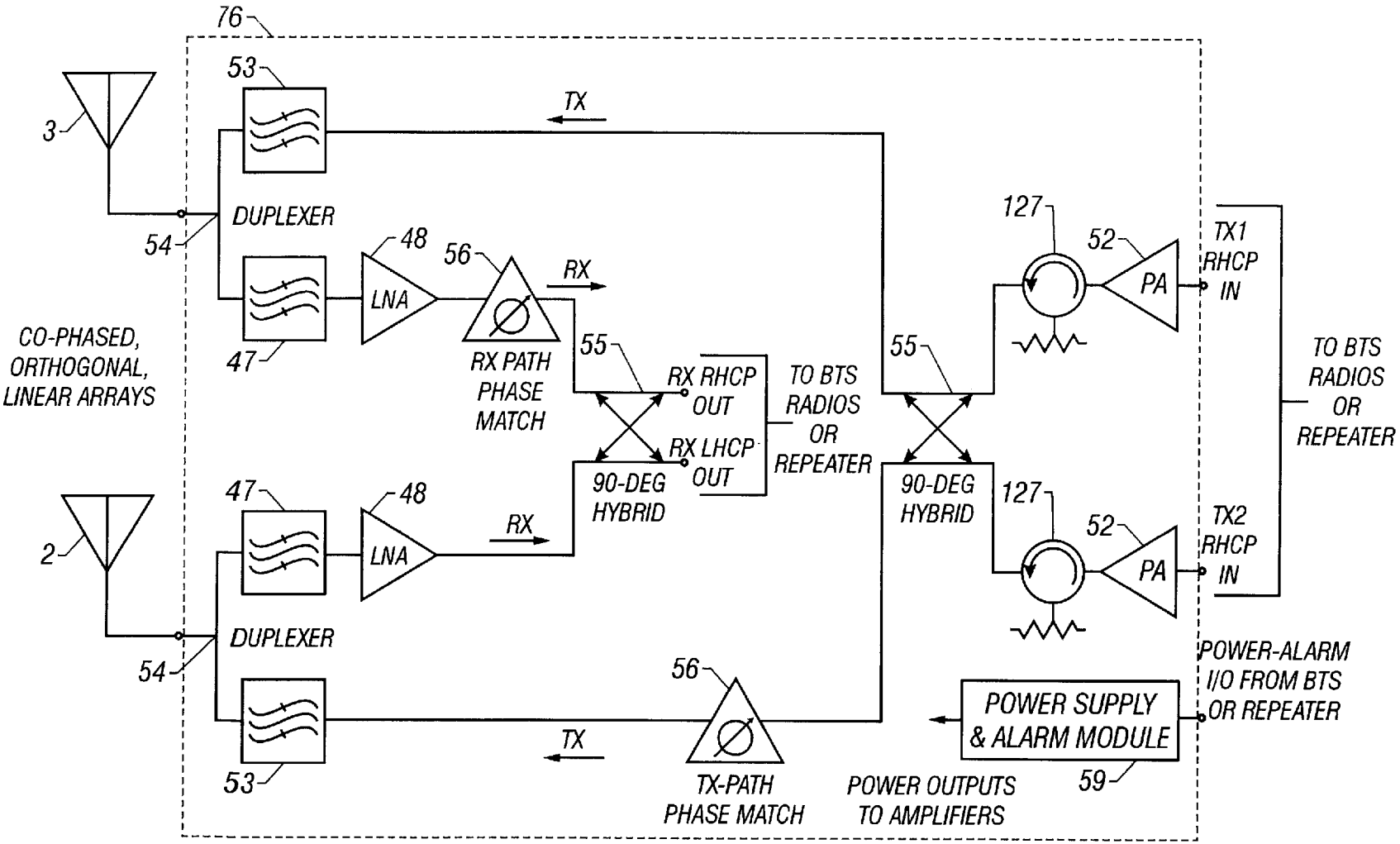

FIG. 10C shows another, circularly polarized configuration. As above, right and left-hand circularly polarized receive signals are available with minimal sensitivity degradation. Circular polarization on the receiving (uplink) path is accomplished using the 90-degree hybrid 55 following phase-matched filtering 47 and preamplification 48. Alternatively, the hybrid 55 may be omitted if linear RX polarization (+/−45 degrees) is desired.

Figure 10D:
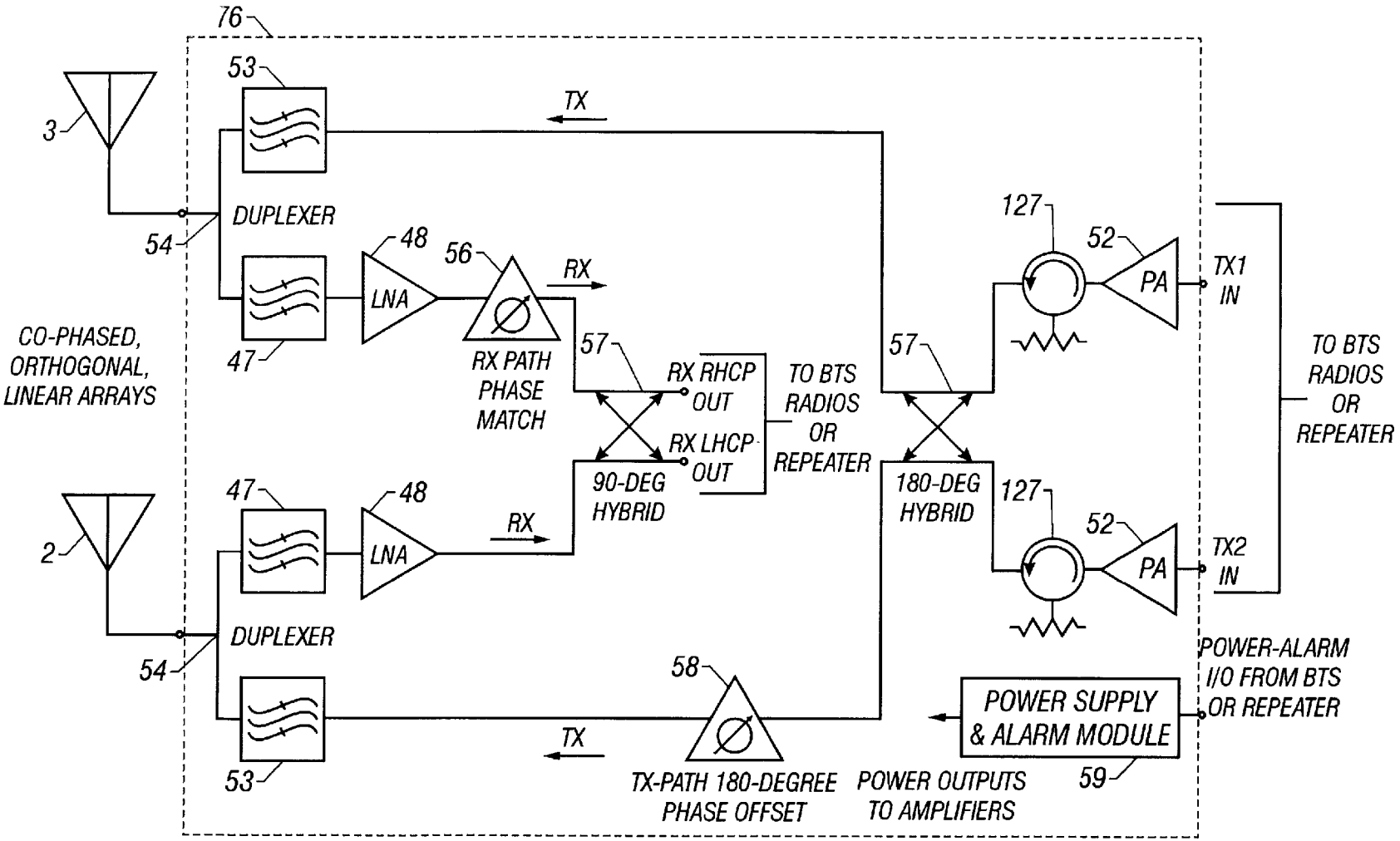

In the TX path of FIG. 10C, a high-power, 90-degree hybrid 60 and appropriate phase compensation 61 are added so that two TX signals can be combined after power amplification 52 using the orthogonally polarized antenna arrays and transmitted in circular polarization with minimal insertion loss including the 3 dB of polarization loss. Isolators 127 are typically offered as part of the power amplifiers 52 but are illustrated for emphasis. Alternatively, the 90-degree hybrid 60 and phase compensation 61 may be omitted so that full power can be transmitted into the slant (+/−45 degree), linear polarizations. Biasing and alarm circuitry for the power amplifier is routed to the power amplifiers using supplemental cabling. In FIG. 10D, a 180-degree hybrid 57 is substituted for the 90-degree hybrid along with a 180-degree phase offset 58 to achieve a vertically polarized composite of the two TX inputs. This topology, using downlink power amplification 52, is especially useful in antenna-repeater applications.

Figure 11A:
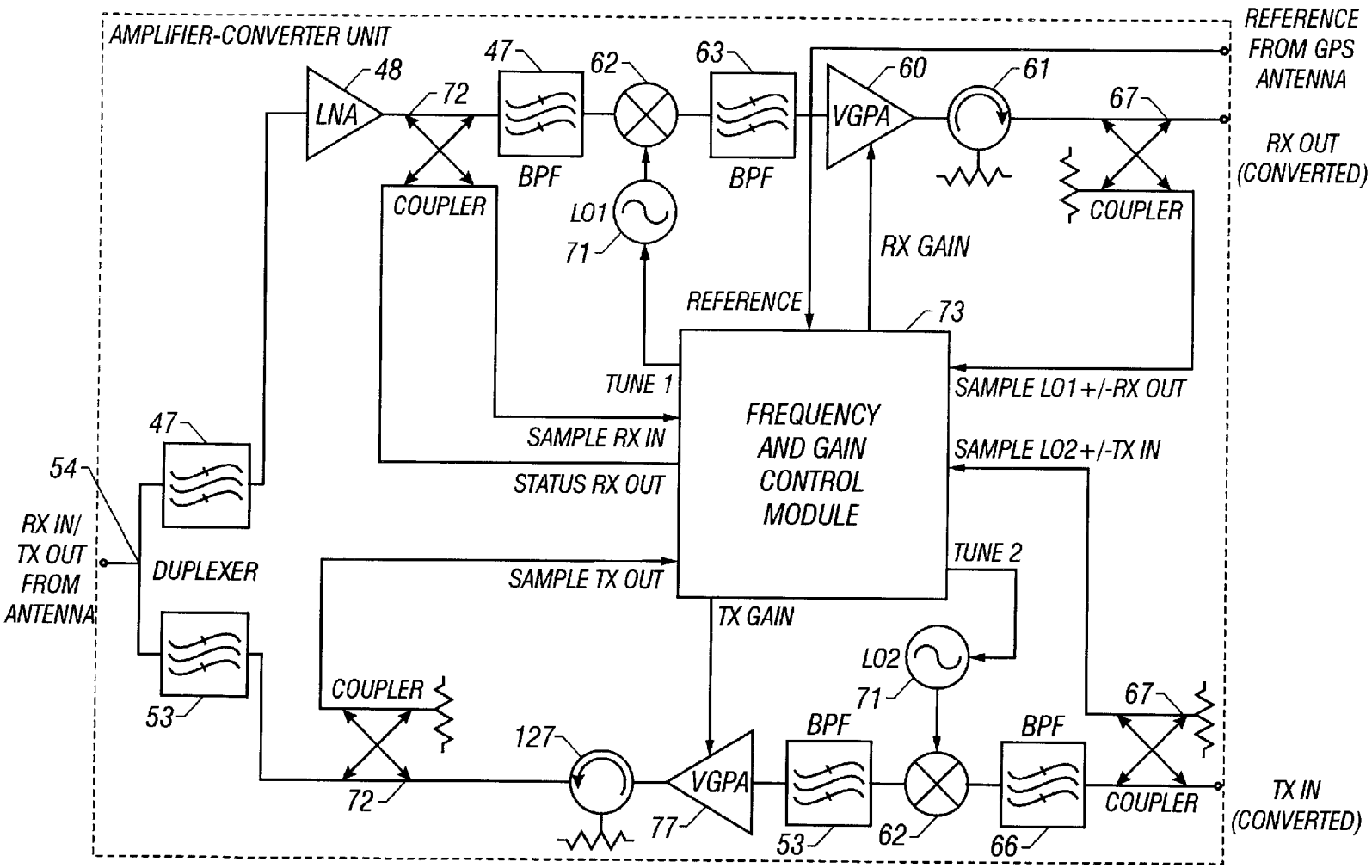
FIGS. 11A–11C are schematic illustrations of frequency-conversion subsystems of an antenna subsystem which implements a concealed wireless repeater.
Figure 11B:
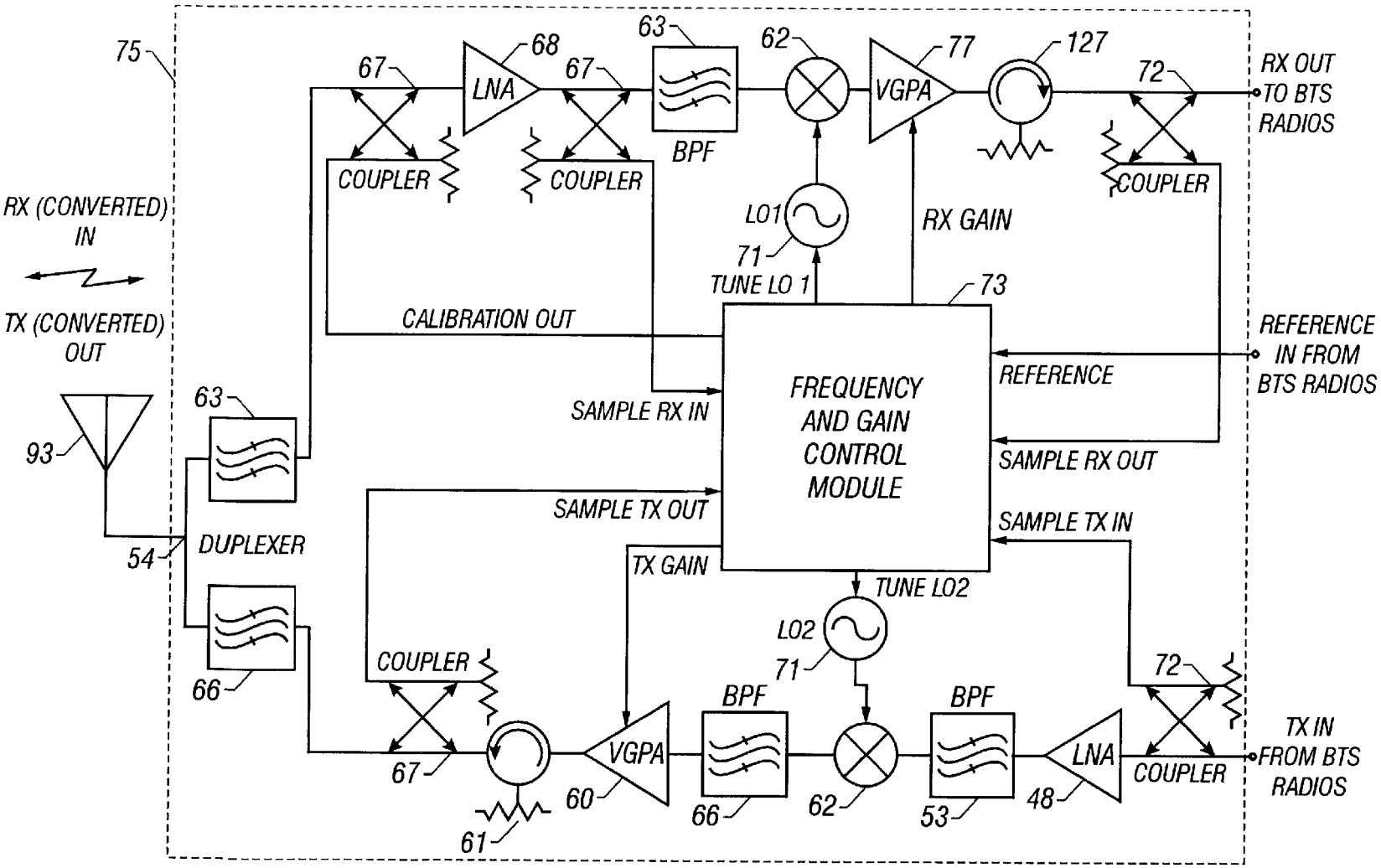
Figure 11C:
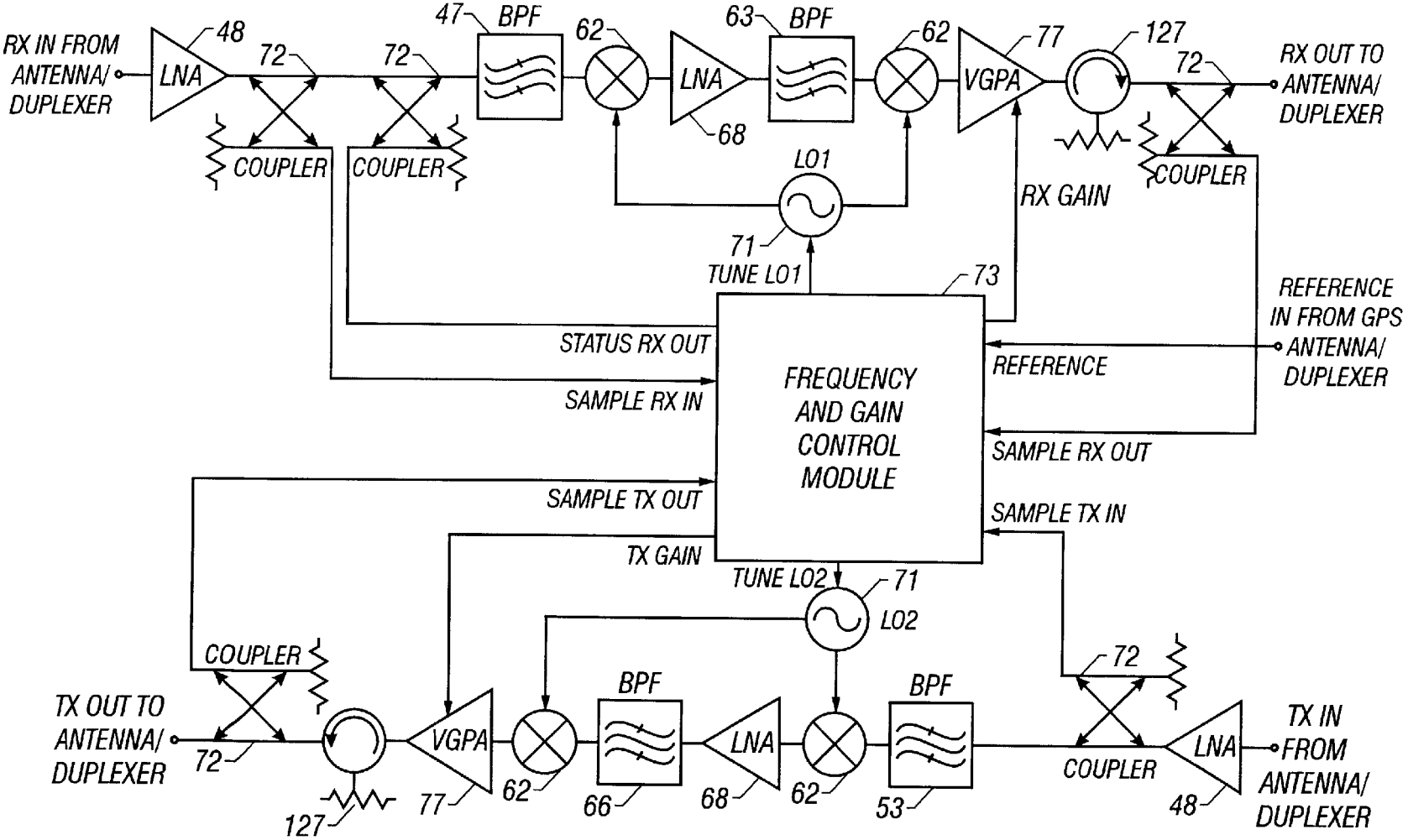

FIGS. 11A–11C are schematic illustrations of frequency-conversion subsystems of an antenna subsystem which implements a concealed wireless repeater. For repeater applications, a frequency up-converter, as diagrammed in FIG. 11A, is used and best described as part of the two-sector, converting Antenna-Repeater Node 80 in FIG. 12A. Referenced to the mobile unit, the preamplified, filtered uplink signal is input at the RX IN/TX OUT port through the RX filter 47 of the duplexer and into the preamplifier 48. A directional coupler 72 is used to sample the RX signal for level measurement and gain control by the frequency and gain control module 73 and inject a status signal onto the RX path for use by the master antenna. The primary output of the coupler 72 is then filtered in the RX filter 47 to remove the image band and fed to a frequency translation device, or mixer 62. In the mixer 62, the frequency is converted to the sum or difference of the uplink frequency, fRX and the frequency, fLO1, of the sign from the local oscillator 71. The BPF 63 suppresses the unwanted outputs from the mixer 62 that include intermodulation products, harmonics, and leakage of the local oscillator signal. A high-frequency, power amplifier 60 boosts the converted, uplink signal level for re-transmission. The gain of the power amplifier 60 is variable and controlled by the control module 73 that also measures the output using a high-frequency directional coupler 67 for comparison against the input as part of an automatic-gain control AGC loop.

Conversely, the translated downlink at the sum or difference of the downlink frequency, fTX, and the second local oscillator 71 frequency, fLO2, is amplified by a high-frequency LNA 68 and split using a divider 69 ( FIG. 12A) before being sampled using a coupler 67 to determine the TX signal level ad control information from the master antenna. The sample of the TX downlink transmissions for reference or control signals can be decoded by the frequency and gain-control unit 73 to stabilize or tune the local oscillators 71, LO1 and LO2, as well as control signal levels. Alternatively, frequency stabilization reference can be provided via a GPS signal that is obtained using a GPS-band antenna 65 (see FIG. 12A) and routed to the control units 73 of both sectors using a GPS-band divider 76. The control unit tunes the local oscillators 71 as commanded by the master antenna and maintains the proper frequency offset for the up-converted RX and TX signals so that the may be properly combined in a duplexer consisting of filters 63 and 66 with a matched summing node 54 (see FIG. 12).

The converted-TX output of the coupler 67 is filtered in filter 66, converted back to the downlink frequency by the mixer 62 using the signal from the second local oscillator 71, and filtered again to reduce harmonics by a TX-bandpass filter 53. A variable-gain, power amplifier 77 that is followed by an isolator 127 boosts the downlink signal before transmission to the mobile unit. A coupler 72 samples the TX output level use by the control module 73 to determine the gain setting for the power amplifier 77. A duplexer consisting of the filter 63 for the uplink re-transmission, the filter 66 for the downlink re-transmission, and a properly matched summing node 67 separates the repeater uplink and downlink signals.

Figures 1, 12B:
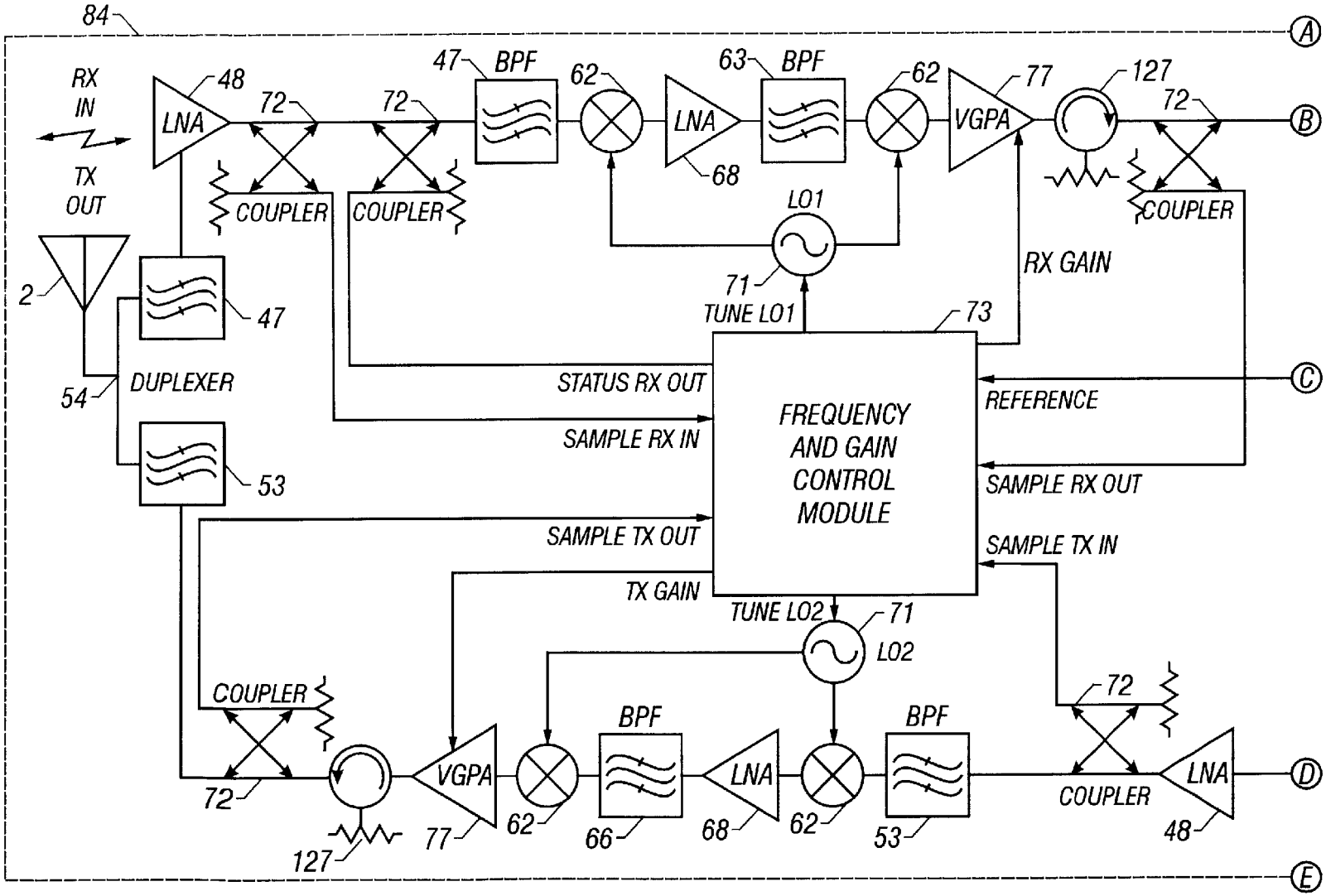
Figures 2, 12B:
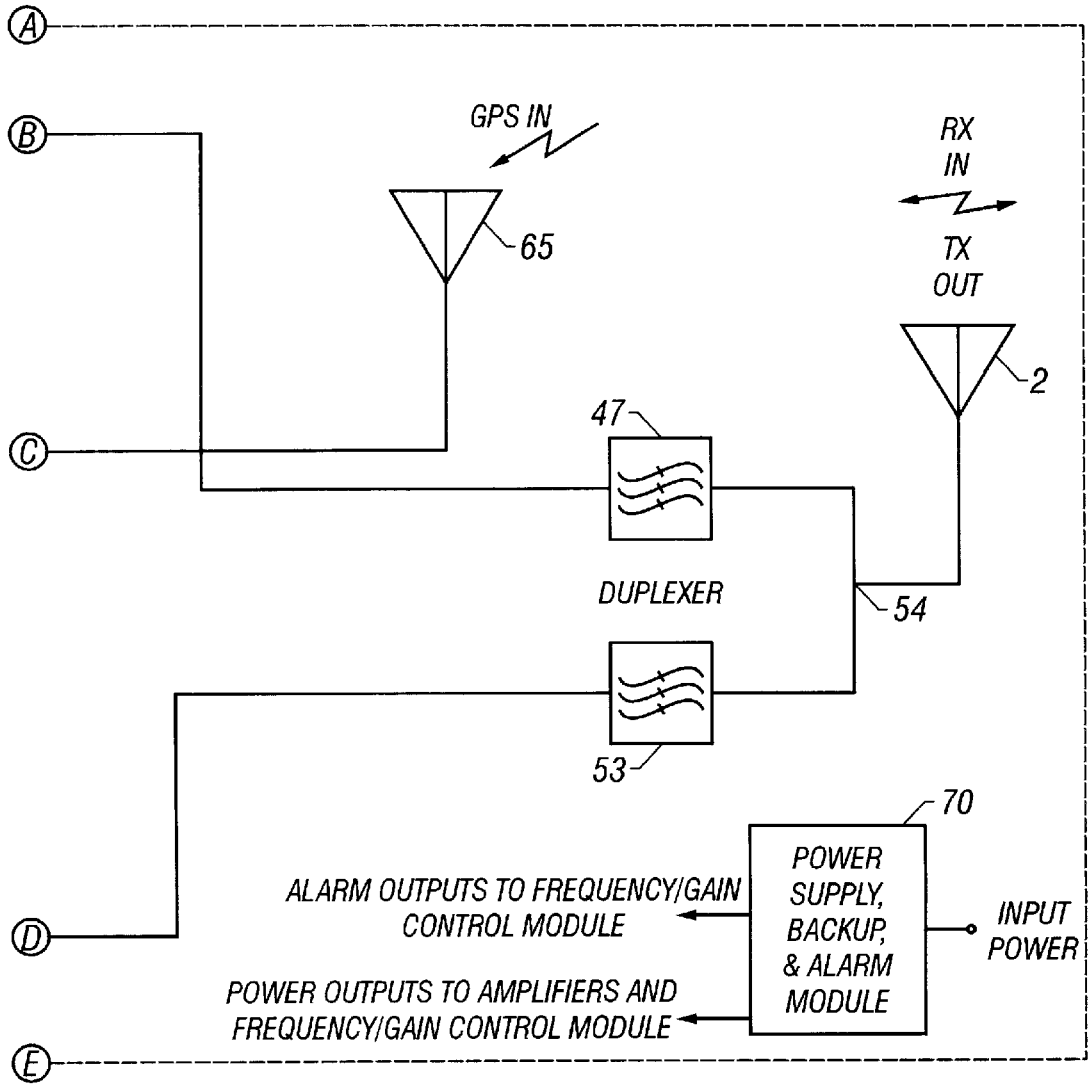

FIGS. 12A–12B are schematic illustrations of antenna-repeater nodes (ARNs) that are distributed throughout an urban area to provide RF coverage. An ARN that covers two sectors is formed as diagrammed in FIG. 12A. One polarization and one array of an antenna repeater system consists of the mobile-band array 2, an up-converter unit, and the high-gain array, dish or horn antenna 6 for the repeater link as shown in FIG. 12A. Using hybrid dividers (or combiners) with adequate isolation 74, a pair of repeater-converter units 76 are cross-connected to share the duplexer consisting of filters 63 and 66, a matched junction 54 and the high-frequency horn or dish antenna 13 for the point-to-point, high-frequency-repeater band. Separate antenna arrays 2 for the mobile unit 79 frequency band are used to achieve coverage in the desired sectors. A power supply module 70 is provided that can accommodate an AC or DC input, provides a −48 VDC battery backup, and DC-DC converters to the required voltages for the various components. Voltages and currents to the amplifiers are monitored and a serial status line is provided to the frequency and gain control module 73 to provide the status output.

Although a two-sector ARN 80 subsystem is shown in FIG. 12A, a three- or four-sector ARN can be similarly implemented. However, omnidirectional nodes are often useful and even preferred. Of course, the concept of the antenna repeater node may be extended to microcells with a microwave, copper line, or fiber-optic T1 link rather than a high-frequency, converting repeater.

The down-conversion process is performed by the down-converter module 76 shown in FIG. 11B. The process is the reverse of the up-conversion process that was just described for the node 80 using the same components. Separate RX and TX connections are provided to the other components of the master antenna which may be duplexed, if desired, depending on the requirements of the installation. The reference and control signals are taken directly from the BTS radios via the master antenna subsystem (described below).

A same-frequency repeater is commonly used to extend coverage into shadowed or blocked areas in conventional systems. When a direct link to the master antenna is unavailable, a same-frequency repeater is useful in this system as well. With adequate antenna isolation and proper control of signal levels, same frequency re-transmission is possible using a double-conversion process as diagrammed in FIG. 11C and used in FIG. 12B to implement a same-frequency repeater. This process is a combination of the up- and down-conversion processes that are outlined in FIGS. 11A and 11B using the same components. The dual-conversion process is used in conjunction with automatic gain control by the control module 73 to maintain the phase and amplitude of the RX and TX signals and eliminate positive feedback due to imperfect isolation between the back-to-back antennas.

Figure 13A:
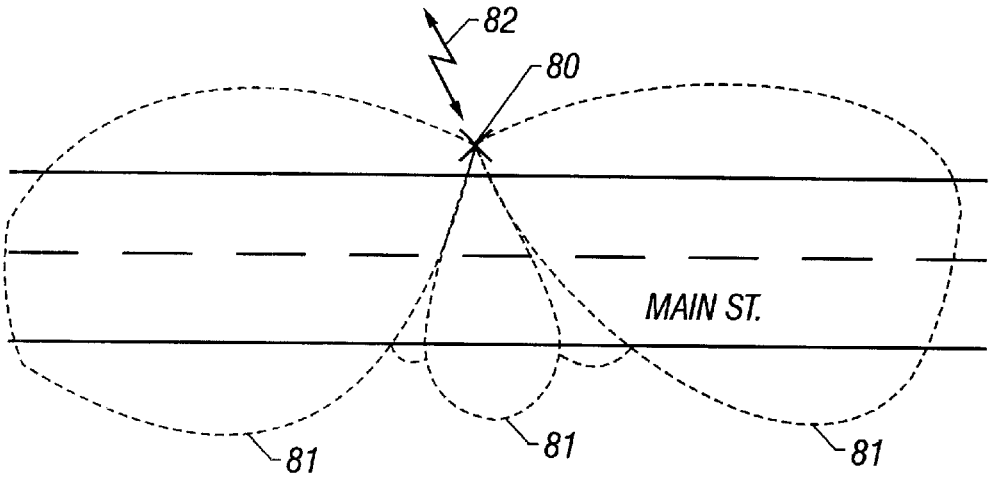
FIGS. 13A–13B are illustrative drawings illustrating the location and coverage area for antenna-repeater nodes within a downtown area.
Figure 13B:
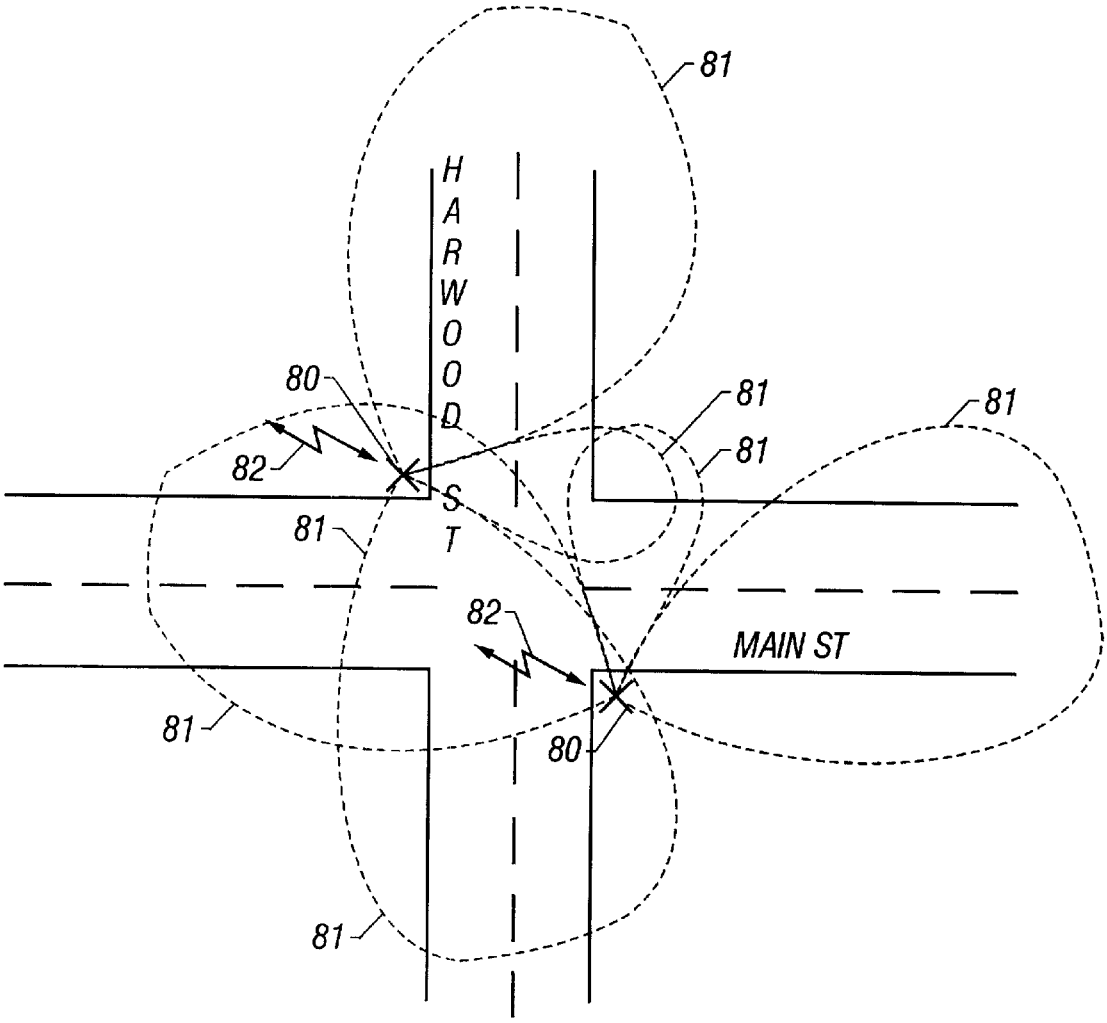

FIGS. 13A–13B are illustrative drawings illustrating the location and coverage area for antenna-repeater nodes (ARNs) within a downtown area. The ARN 80 is critical to providing service up and down city streets, along freeway corridors, inside tunnels, and other locations where a direct line-of-sight from a mobile unit to the master antenna system cannot be achieved. The two-sector ARN that can be concealed in a street lamp provides mobile-band coverage 81 along a street with high-frequency, directional link 82 to the master antenna as shown in FIG. 13A. Similarly, two 2-sector ARN's that may be disguised within street lamps or traffic signal poles provide coverage at an intersection in FIG. 13B.

Figure 13C:
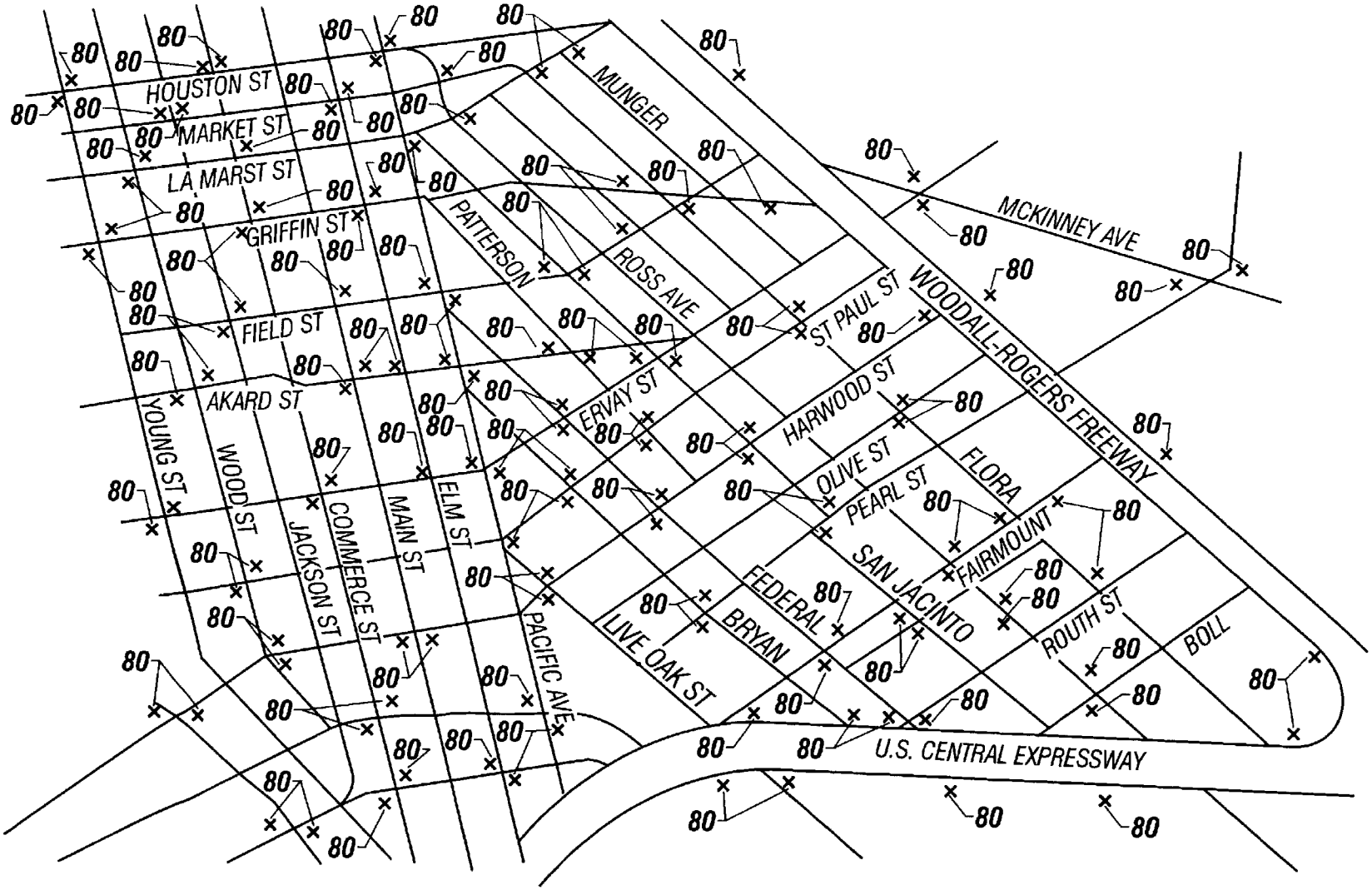
FIG. 13C is a map of a downtown area illustrating a plurality of antenna-repeater nodes distributed in accordance with the teachings of the present invention.

A network of ARNs 80 can be distributed throughout an urban area as indicated in FIG. 13C. By locating nodes at every significant intersection and periodically along freeways, an entire urban area can enjoy excellent service. By comparing signal strengths of mobile transmissions between nodes, 911 locations can be accurately computed even within areas that would be shadowed in current cellular systems.

Figure 14:
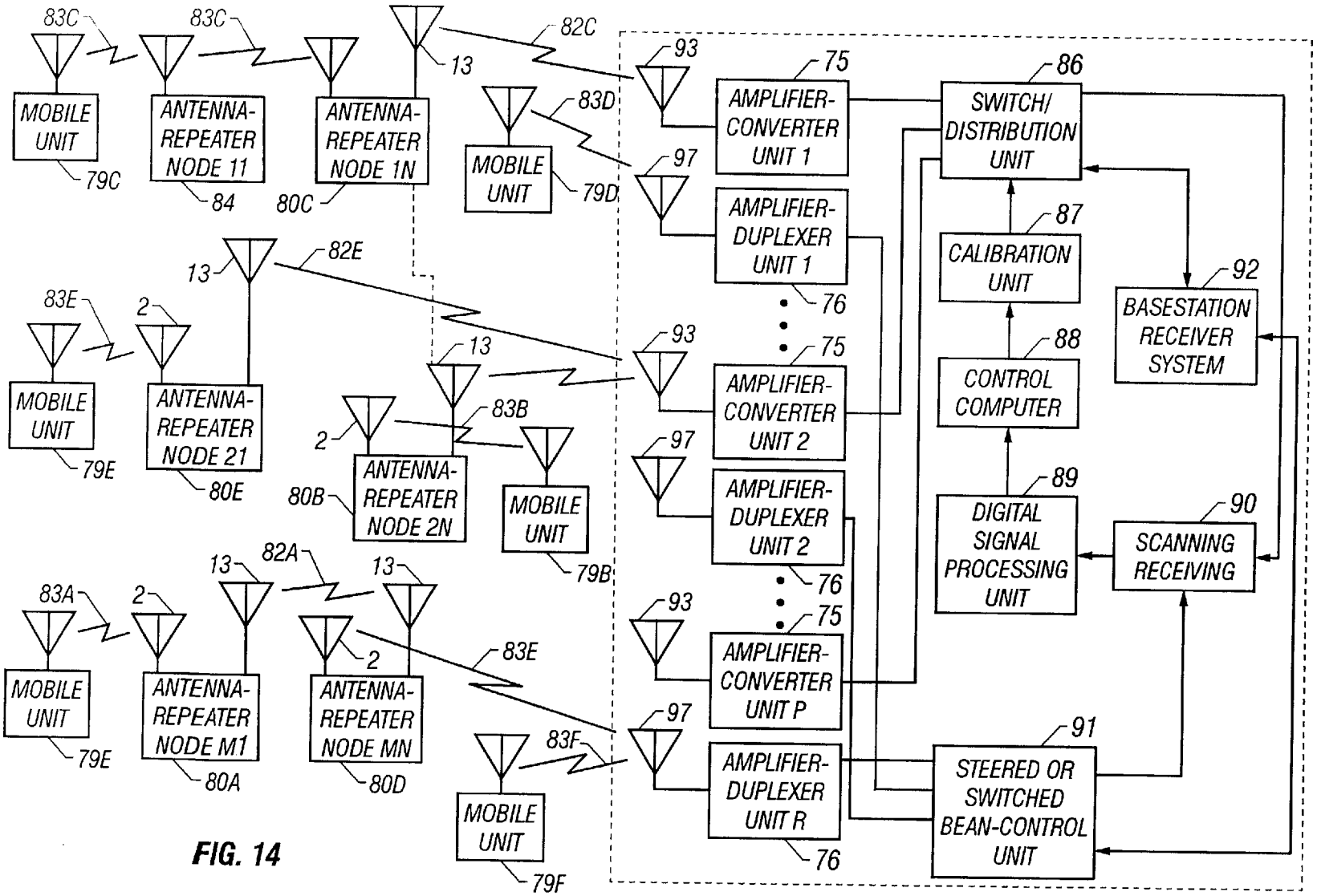
FIG. 14 is a block diagram of a distributed urban supercell in which antenna-repeater nodes are concealed in remote pole or panel-like structures, and are linked to a beam-steering subsystem, to an intelligent antenna subsystem, and to a base station.

FIG. 14 is a block diagram of a distributed urban supercell in which antenna-repeater nodes are concealed in remote pole or panel-like structures, and are linked to a beam-steering subsystem, to an intelligent antenna subsystem, and to a base station. FIG. 14 illustrates six mobile units 79A–79F, and various links between the mobile units, ARNs 80A–80E, 84, and the master antenna 93, 97. The uplink and downlink between the mobile unit and the base station is accomplished via several paths. First, a direct link 83D in the mobile band is available using the steered- or switched-beam arrays 97 that are concealed behind spandrel panels 16 along with filter-amplifier units 76. These arrays are steered by a beamforming unit 91 that combines the individual arrays with the necessary phase and amplitude weightings to adaptively provide the optimal spatial characteristics or switches between the individual arrays to select the best one for the link. These arrays can be used to reach near-downtown and suburban areas or penetrate other buildings.

Alternatively, links 83B and 83E are available between mobile units 79B and 79E and the ARNs 80B and 80E, respectively. The frequency-converted signals from these ARNs can be linked directly through the radio links 82B ad 82E to a bank of high-gain, higher-frequency, panel antennas 93 (alternatively, horns or dishes 13) and converted back to the band of the mobile unit by the amplifier-converter unit 75. When the path from the ARN to the master antenna system 95 is obstructed, the ARNs can also be linked to provide a third path (83A to 82A to 83E) from the mobile 79A to the master antenna. For ARN's using same-frequency repeaters, the third path is shown from mobile 79C links 83C to 83C to 82C. The link 82A represents the cross-node path for the converted link from ARN to ARN that exchanges the normal converted RX and TX frequencies to retransmit a replica 83E of the mobile transmission 83A. The switch/distribution unit 86 can be used to select the optimal link as determined by the master antenna control system. Finally, the ARN nodes can include the necessary electronic circuitry to constitute a miniature base station that relays data via a terrestrial or microwave T1 connection.

The system can perform self-testing and calibration by transmitting test signals from the master antenna subsystem 95 to the nodes 80. Test signals are generated by the calibration unit 87 at the command of the control computer 88. The test signals are distributed to the amplifier converter units 75 by the switch-distribution unit 86 and converted to the repeater-link band 82. The test signal radiates from the arrays 93 of the master antenna and links 82 to the ARN's 80. The test signal is converted back to the band of the mobile units and linked 83 to adjacent nodes or the master antenna arrays 97. As the test signal passes from node 80 to node 80, it can be encoded with the identification of each node. Since the location of each node is stored in the memory of the control computer 88 and each ARN 80 has added an identification code the test transmissions, the entire path can be mapped and measured for calibration.

When the test signal is linked back to the master antenna at the mobile band 83 or the repeater band 82, the scanning receiver 90 samples each channel via the beam-control unit 91 or the switch-distribution unit 86, respectively. The scanning receiver converts the sampled signals for processing by the digital-signal-processing unit 89 that extracts information regarding the identification of the nodes along the path, signal quality, delay, multipath characteristics, etc. The information is then processed by the control computer 88 for optimizing the complete link to the mobile and tracking in the case of 911 emergencies.

Figure 15:
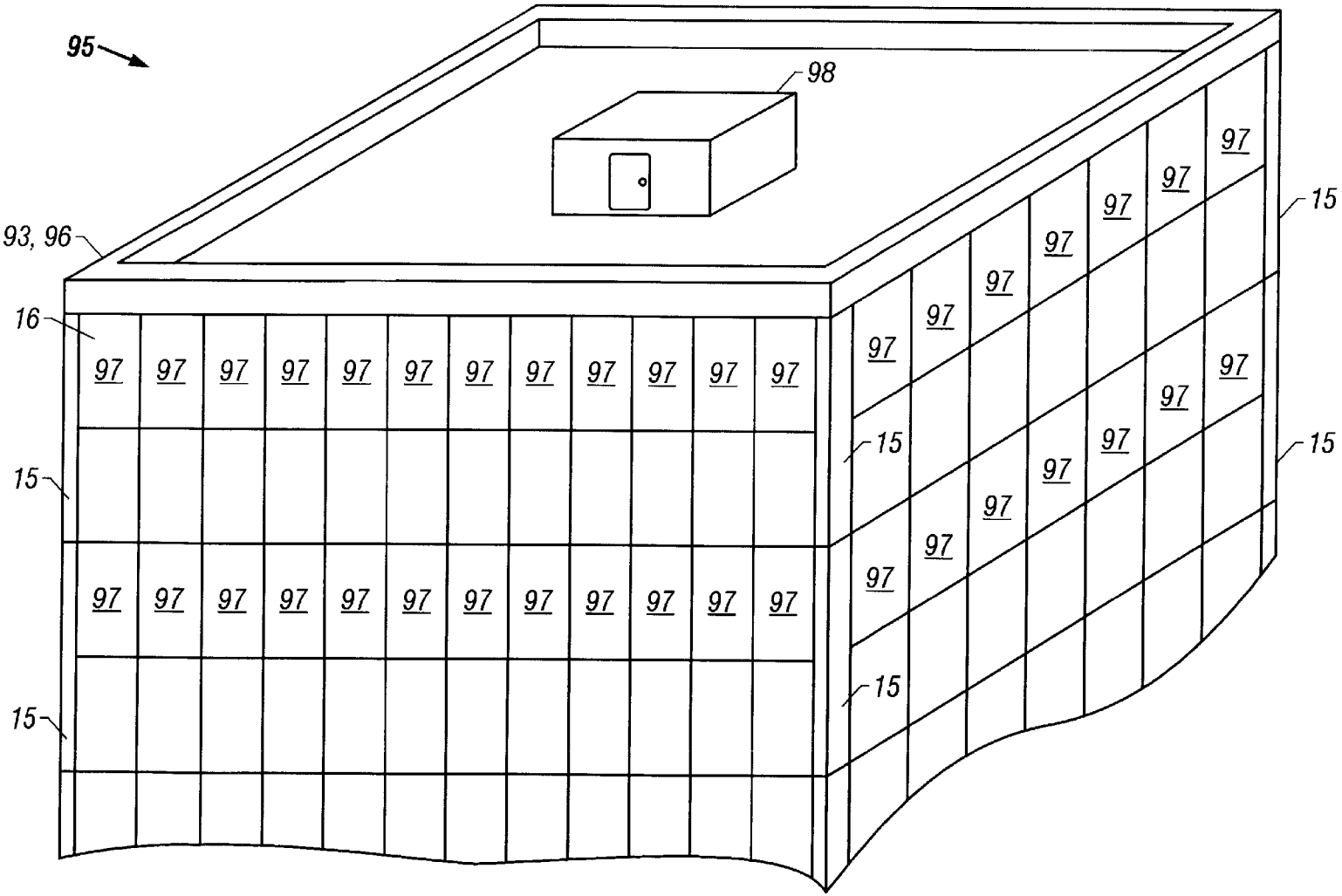
FIG. 15 is a perspective view of a high-rise building having a master-antenna subsystem of an urban supercell concealed within the top of the high-rise building.

Above the street level, layering of ARN nodes or picocells can be accomplished by also packaging them into the curtain-wall system components 15–22 to provide in-building penetration among the large, densely occupied buildings within the urban area. FIG. 15 is a perspective view of a high-rise building having a master-antenna subsystem of an urban supercell concealed within the top of the high-rise building. The penthouse 98 houses the switch-distribution unit 86, calibration unit 87, control computer 88, digital signal processing unit 89, scanning receiver 90, beam-control unit 91, and the base station 92. Mobile-band arrays 2,3 are hidden, along with amplifier duplexer units 75, behind spandrel panels 16 to form larger, steerable arrays 97. The capstone 96 can be used to conceal the very-high frequency antennas and associated components for the repeater band. The mullion 15 can conceal the cabling for the steerable arrays 97.

Figure 16:
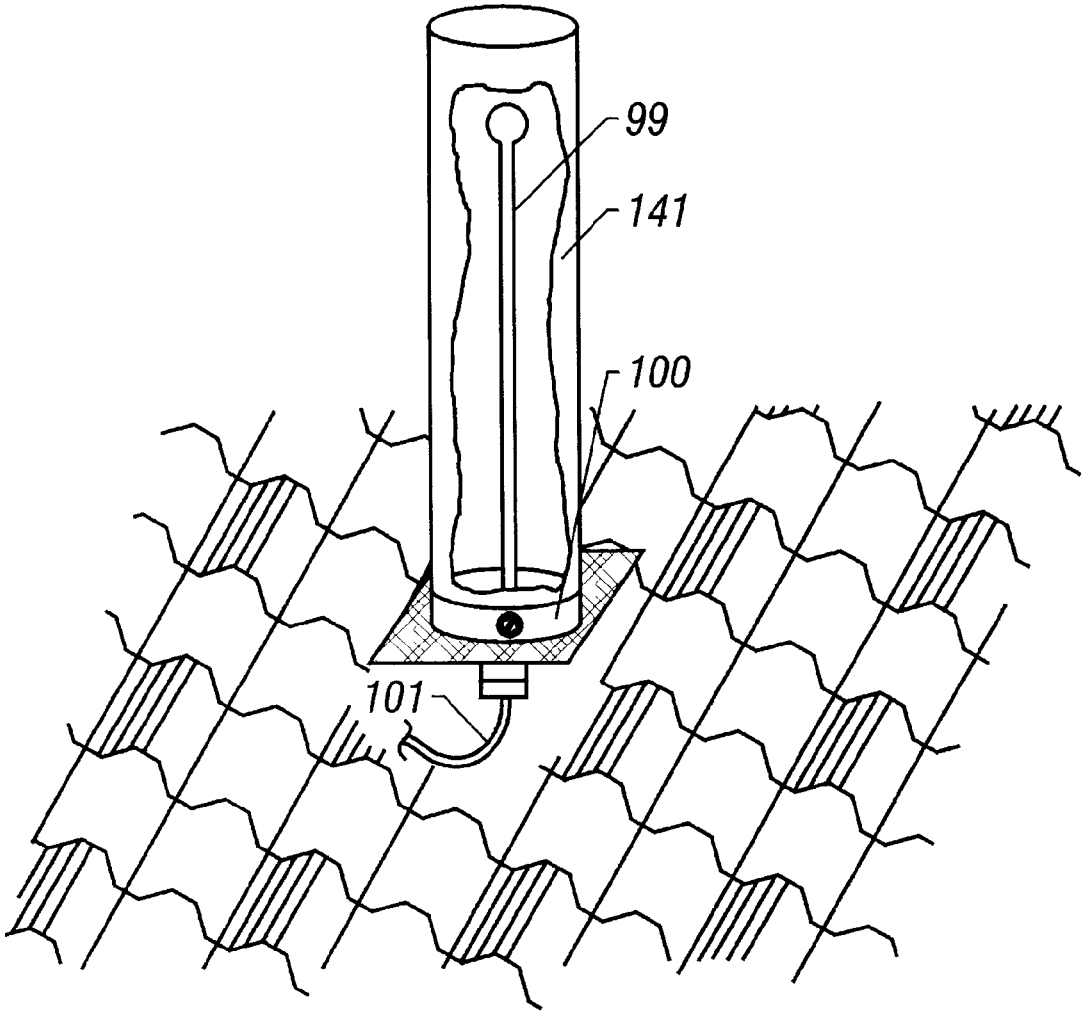
FIG. 16 is a front side, cut-away view of a monopole antenna for a wireless residential converter system concealed within a plastic vent pipe for a residence.

FIG. 16 is a front side, cut-away view of a monopole antenna for a wireless residential converter system concealed within a plastic vent pipe for a residence. Like large buildings, antennas are concealed within exterior features found on a home. Unlike base station antennas, these antennas provide low to moderate gain and handle low power levels. If necessary in remote locations, higher gain, flat panel arrays are concealed within the sides of a chimney. Faux ventpipes, as described in the prior art, can be used to conceal ads. However, at the frequencies that are commonly used for cellular communications, ventpipes, when made from a suitable plastic, can form simple radomes to conceal omnidirectional monopoles, dipoles, or dipole arrays that are readily available for mounting on vehicles. FIG. 16 illustrates a plastic vent pipe 141 concealing a monopole antenna 99 that is mounted to a supporting frame or base 100 that allows the antenna's connector to protrude below it, pass through the roof and attach to a cable 101. Similarly, these can be concealed within flag poles that are mounted on or near the home or lamp posts as previously described.

Figures 1, 17:
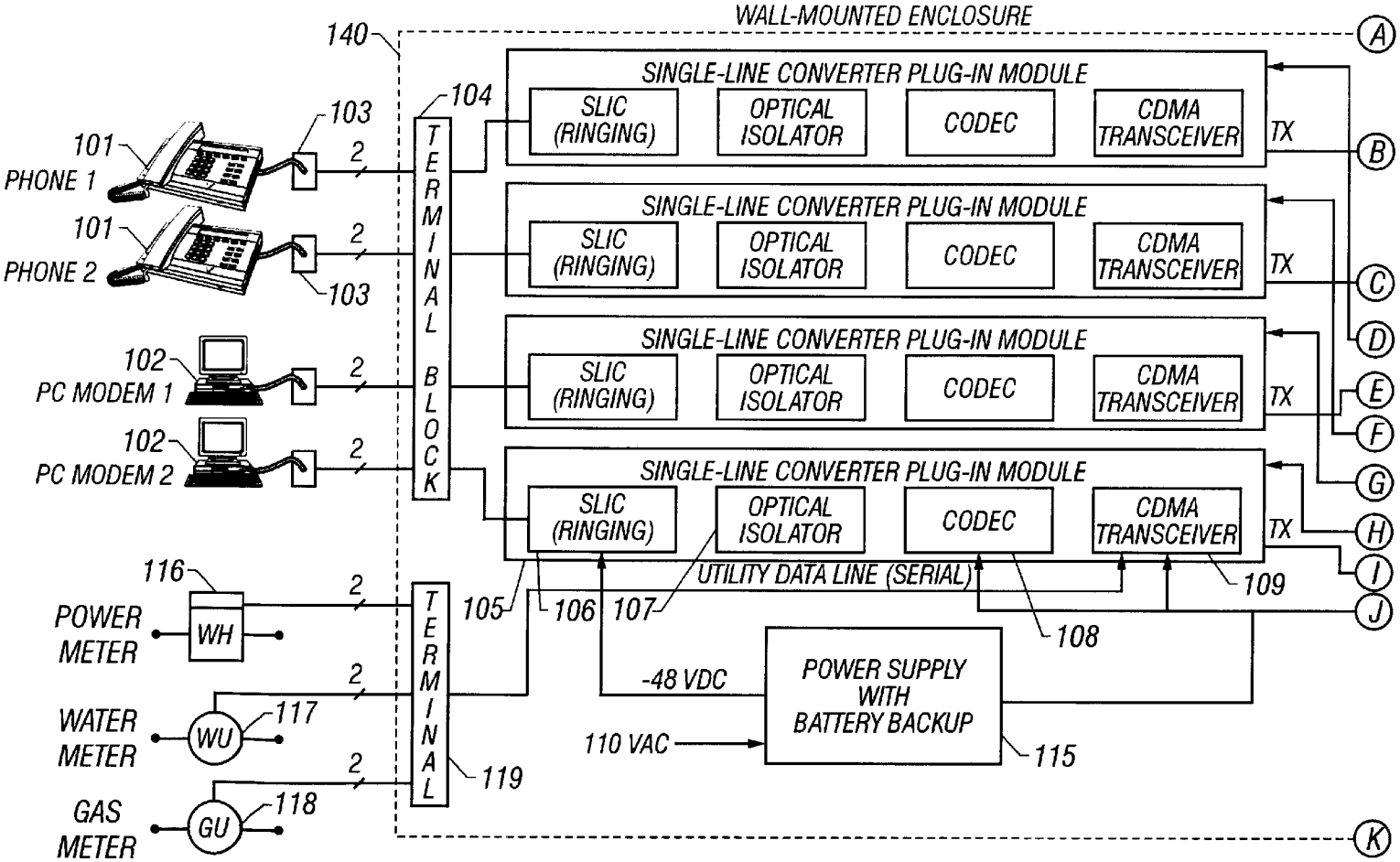
FIG. 17 is a schematic illustration of a Wireless Residential Converter (WRC) subsystem that provides a wireless interface to common, wireline telephones.
Figures 2, 17:
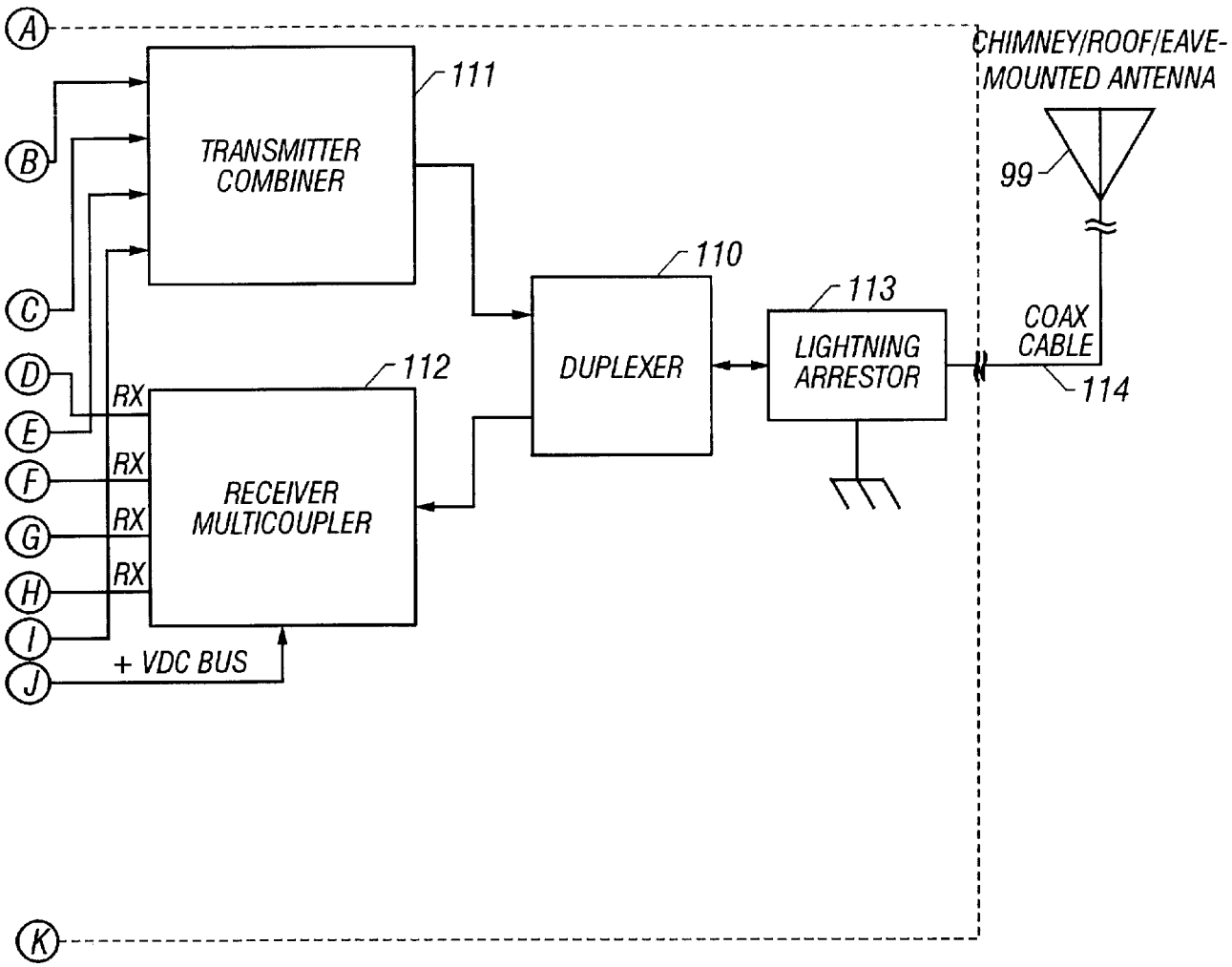

FIG. 17 is a schematic illustration of a Wireless Residential Converter (WRC) that provides a wireless interface to common, wireline telephones. In this implementation, two wire-line telephone sets 101 and two PC modems 102 are connected to wall jacks 103 and routed through the residence via two-conductor telephone wire. The wires are routed to a common location where the wireless residential converter is contained in a wall mounted enclosure 140. The wires are connected to a terminal block 104 inside the enclosure 140 that is, in turn, connected to the subsystem motherboard. The system motherboard provides routing and connectors for power, serial data, and RF signals to the single-line converter modules (SLCM) 105. All embedded software, memory, and active circuitry is contained within the SLCM. Each SLCM 105 contains four major circuits: a ringing subscriber-line-interface circuit (SLIC) 106, an optical isolator 107, a codec 108, and a radio-telephone transceiver circuit 109. The transmitted (TX) and received (RX) signals from multiple SLCM transceivers 105 are combined 111 and distributed 112, respectively, to a common duplexer 110 that filters and combines the spectrum onto a common antenna port. Before routing these signals to and from the antenna 99 using a coaxial cable 114, a shorted stub with an earth ground acts as a lightning arrestor 113 to protect the subsystem. (Alternatively, the shorted stub 113 may be located at the connection to the antenna 99 and grounded.) A power supply with a battery backup for emergencies 115 is also provided. Also depicted are an optional electronic power meter 116, water meter 117, and gas meter 118 that provide serial outputs to another terminal block 119 for a common serial utility data line. The serial outputs of the meters are polled from any available SLCM when interrogated by the mobile telephone system.

Figures 1, 18:
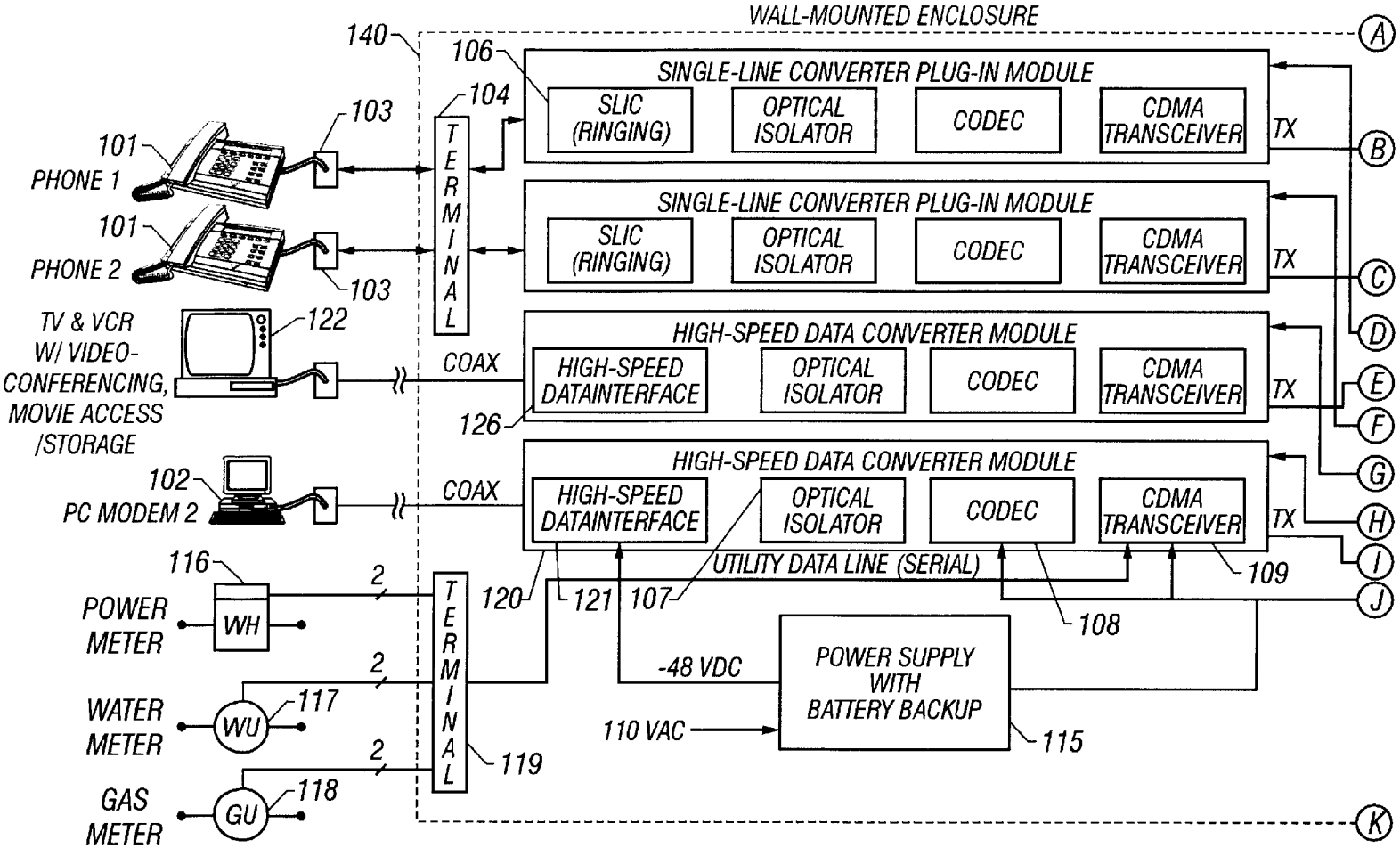
FIG. 18 is a schematic illustration of an alterative embodiment of the WRC of FIG. 17.
Figures 2, 18:
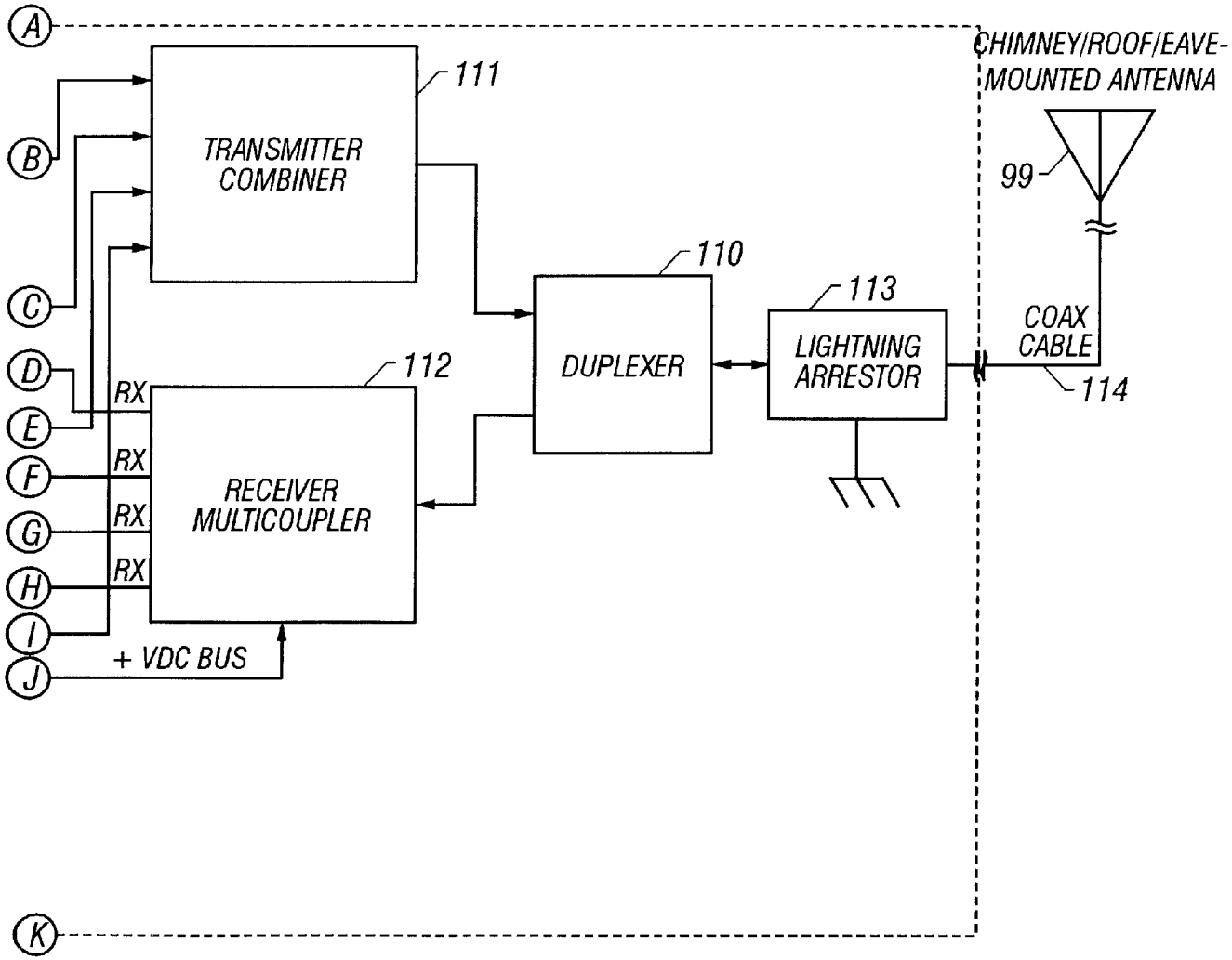

FIG. 18 is a schematic illustration of an alternative embodiment of the WRC of FIG. 17 employing wideband CDMA technology. SLCM's are replaced with modules 120 containing wideband CDMA transceivers and high-speed modem 121 or video interface circuits 126. To facilitate teleconferencing, multimedia, and internet services, these modules provide high-speed data transfer via coaxial cables or other means to appropriately equipped TV's, VCR's, PC's, or other devices 122.

Figure 19B:
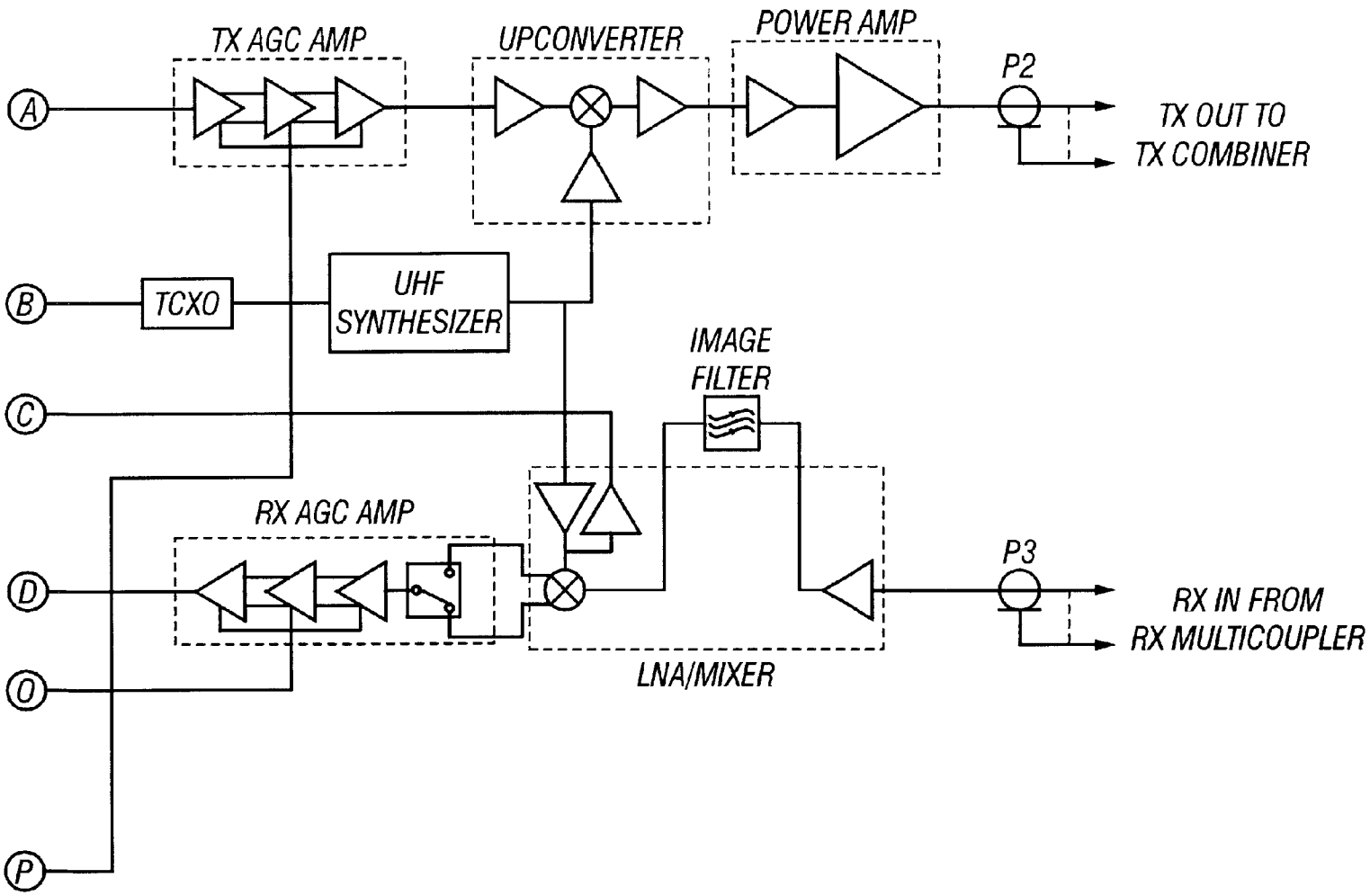
FIG. 19 is a schematic illustration of a Single-Line Converter Module (SLCM) that contains the primary components that function as a wireless transceiver and necessary elements to emulate a wireline telephone system.
Figure 19C:
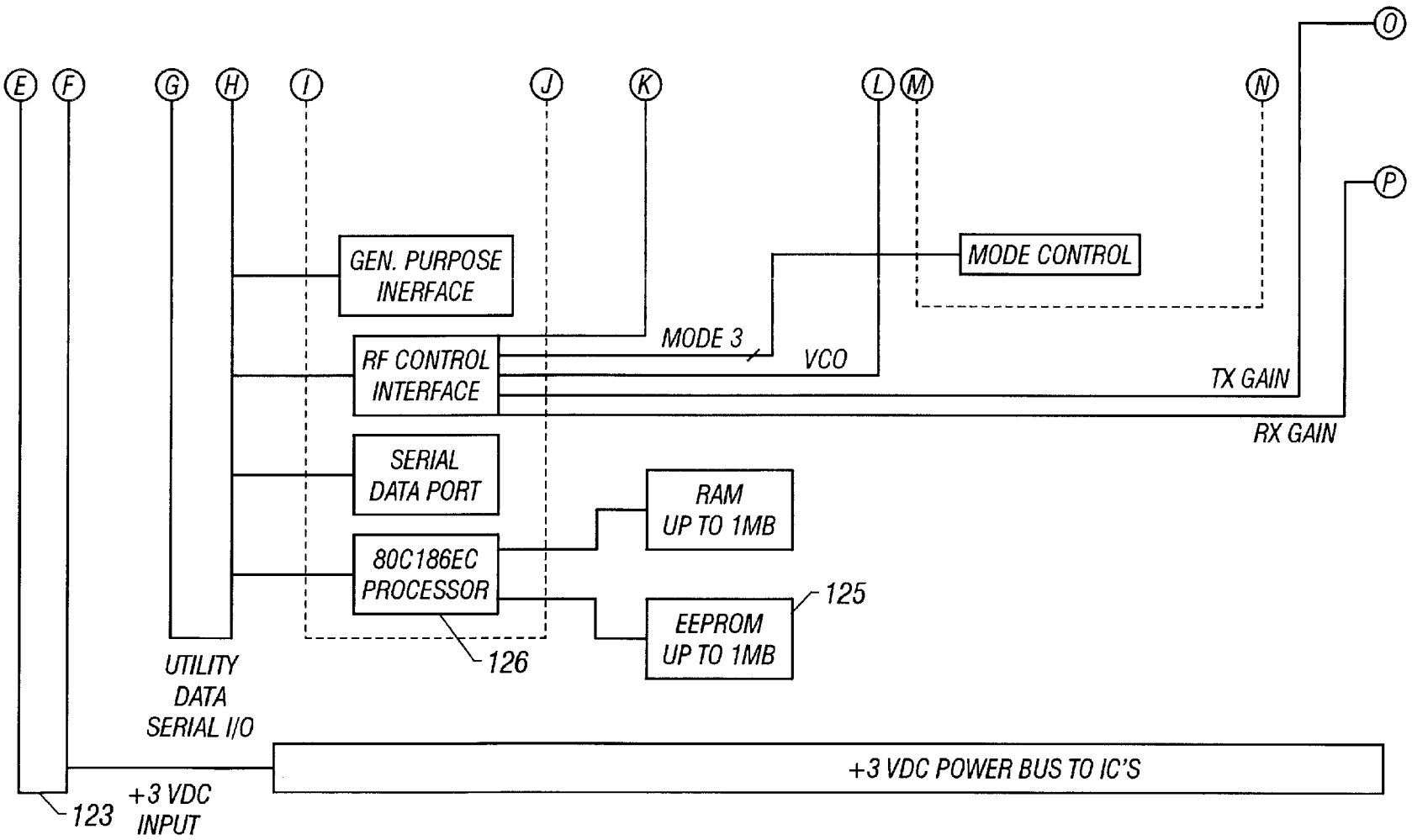

FIG. 19 is a schematic illustration of a Single-Line Converter Module (SLCM) that contains the primary components that function as a wireless transceiver and necessary elements to emulate a wireline telephone system. All inputs and outputs except the RF ports are on a common connector 123, P1. The two-wire telephone lines are mated to a typical subscriber-line-interface circuit, or SLIC 106. An optical isolator 107 is provided between the SLIC 106 and the CODEC 108 to isolate the SLIC and the telephones from other voltages, transients, or discharges. The remaining components are essentially the portion of a mobile phone without a keypad, earphone, microphone, display, battery pack, and housing. Although a CDMA transceiver is depicted, transceivers using other modulation standards may be accommodated. Dial tone, busy signals, call waiting, and other signals are produced by the DSP 124 using embedded software that is in an EEPROM 125. DTMF tones from the wireline telephone are interpreted by the microprocessor 126 and software then converted to user commands and call setup information for the transceiver. The embedded software also controls serial data access and formatting for the utility meter functions. Transceiver command and control is relegated to the mobile telephone system as usual.

Figure 20:
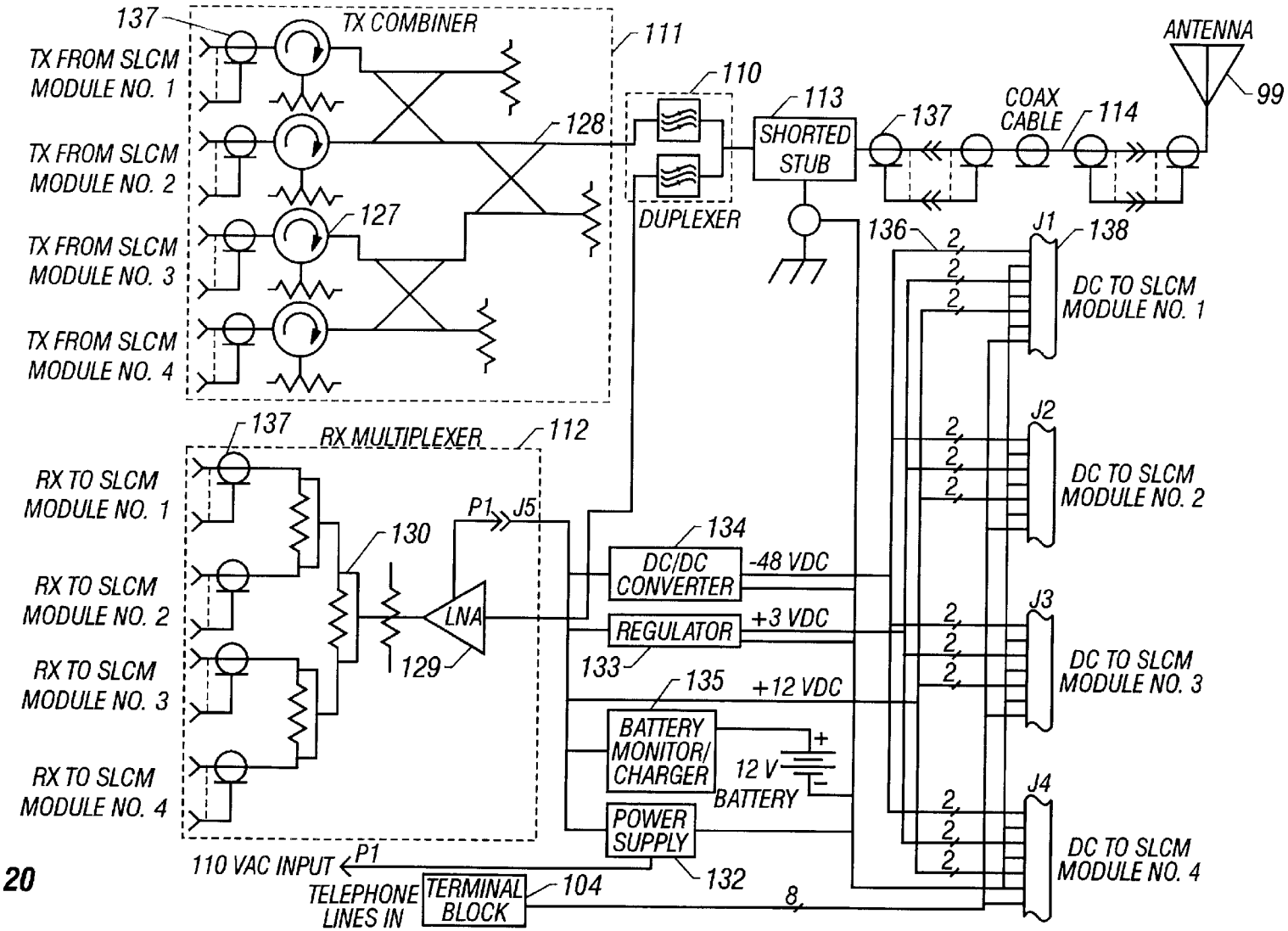
FIG. 20 is a schematic illustration of the electronics that provide multiple telephone lines using up to four WRC modules and a single antenna as well as power and a battery backup.

FIG. 20 is a schematic illustration of the electronics that provide multiple telephone lines using up to four WRC modules and a single antenna as well as power and a battery backup. The uplink TX signals are combined 111 onto a common path in a manner that prevents the transceivers from interfering with each other using isolators 127 and hybrid couplers 128. Received RX signals from the BTS are preamplified 129 (if necessary) and divided 130 equally among the SLCM's. A duplexer 110 combines the uplink TX and RX signal spectra onto a common path to the antenna. The AC power supply 132 converts 110 VAC to +12 VDC that drives DC-DC converter (or regulator) to +3 VDC 133 for the transceiver IC's, a DC-DC converter to −48 VDC 134 for the SLIC, and a battery-charger circuit 135 for the +12 VDC battery backup. The motherboard interconnections 136, RF connections 137, SLCM module jacks 138 and the terminal block 104 arm also depicted.

Figure 21:
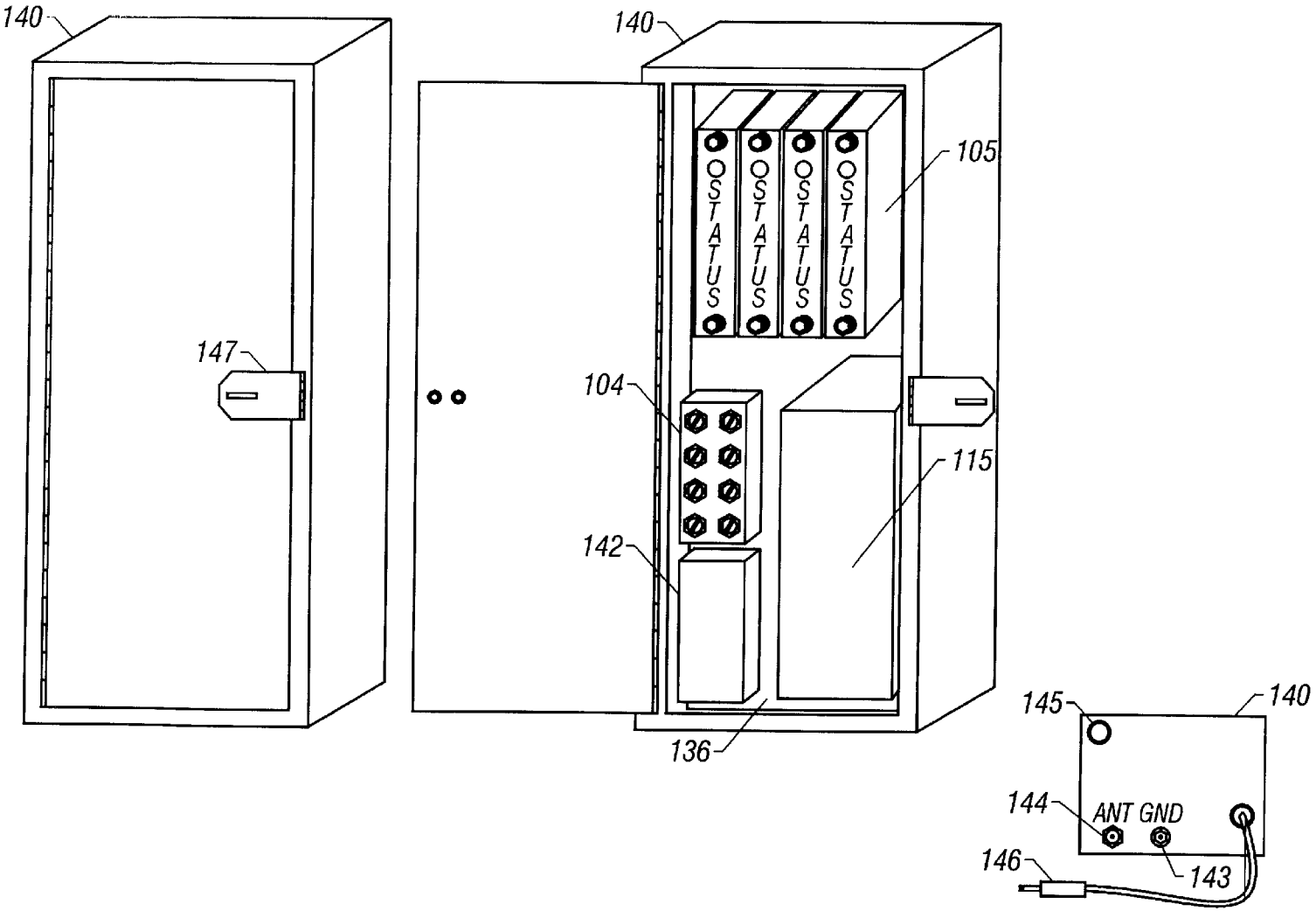
FIG. 21 is a perspective view of a utility box in the open and closed positions that contains the primary modular elements of the WRC system except for the antenna.

FIG. 21 is a perspective view of a utility box in the open and closed positions that contains the primary modular elements of the WRC system except for the antenna. The utility box may be a wall-mounted, utility enclosure 140 with a padlock provision 147. SLCMs 105 take the form of plug-in modules that connect to a backplane circuit board 136 that provides signal and power distribution. A shielded replaceable power supply module 115 is housed in the lower portion of the utility enclosure 140. A duplexer, lightning arrestor, and amplifier are housed beneath a shielded cover 142, and are connected to the backplane 136. These components are located near a connection for an antenna cable 144 and a lightning arrestor ground lug 143. A terminal block is situated nearby so that it is in close proximity to the conduit 145 that passes the telephone wires into the enclosure.

It is thus believed that the operation and construction of the present invention will be apparent from the foregoing description. While the method, apparatus and system shown and described has been characterized as being preferred, it will be readily apparent that various changes and modifications could be made therein without departing from the spirit and scope of the invention as defined in the following claims.

What is claimed is:

1. A method of concealing a base station radio frequency (RF) antenna array in a modified component of a common object comprising the steps of:

constructing the modified component from a dielectric material;

mounting the antenna array inside the modified component so that the antenna is not visible to an observer; and substituting the modified component for a normal component of the common object.

2. The method of concealing a base station RF antenna array of claim 1 wherein the step of mounting the antenna array includes mounting a microwave dish inside the modified component.

3. The method of concealing a base station RF antenna array of claim 1 wherein the step of mounting the antenna array includes mounting a horn antenna inside the modified component.

4. The method of concealing a base station RF antenna array of claim 1 wherein the step of constructing a modified component from a dielectric material includes constructing an elongate tube that is normally found in an urban setting and does not appear to be an antenna housing.

5. The method of concealing a base station RF antenna array of claim 4 wherein the step of constructing an elongate tube from a dielectric material includes the steps of:

constructing the tube in a shape which duplicates a top portion of a common pole-like object; and substituting the tube for the top portion of the common pole-like object.

6. The method of concealing a base station RF antenna array of claim 4 wherein the step of mounting the antenna array includes mounting at least one conforming panel array in the elongate tube.

7. The method of concealing a base station RF antenna array of claim 4 wherein the elongate tube is physically mounted on top of an enclosure at the base thereof, and the method further comprises mounting antenna components comprising a picocell base station in a cellular telephone network inside the enclosure.

8. The method of concealing a base station RF antenna array of claim 1 wherein the step of constructing a modified component from a dielectric material includes constructing the modified component to resemble a common object selected from the group consisting of:

a vertical building column;

a vertical building mullion; and a horizontal building rail.

9. A method of concealing a base station radio frequency (RF) antenna and associated antenna components in a modified panel-like component of a common structure comprising the steps of:

constructing the modified panel-like component from a dielectric material;

mounting the antenna and the antenna components behind the panel-like component in a position in which the antenna radiates through the dielectric panel-like component and is not visible from in front of the panel-like component; and substituting the modified panel-like component for a normal component of the common structure.

10. The method of concealing a base station RF antenna and associated antenna components in a panel-like structure of claim 9 wherein the step of constructing the modified panel-like component includes constructing a panel-like component which duplicates a common panel-like component selected from the group consisting of:

a billboard;

a street sign;

a building spandrel panel;

a building roof panel;

a ceiling tile; and a building wall panel.

11. The method of concealing a base station RF antenna and associated antenna components of claim 9 wherein the step of mounting the antenna and the antenna components behind the modified panel-like component includes a step selected from the group consisting of:

mechanically fastening the antenna and the antenna components to a back surface of the panel-like component;

adhering the antenna and the antenna components to the back surface of the panel-like component; and embedding the antenna and the antenna components within the dielectric material of the panel-like component.

12. The method of concealing a base station RF antenna and associated antenna components of claim 9 wherein the antenna comprises a plurality of antenna elements, and the step of mounting the antenna behind the panel-like component includes mounting the plurality of antenna elements in an array configuration.

13. The method of concealing a base station RF antenna and associated antenna components of claim 9 wherein the panel-like component includes a wall-mounted enclosure mounted on the back surface thereof and the antenna components comprise a picocell base station in a cellular telephone network, the step of mounting the antenna components including mounting the antenna components inside the enclosure.

14. A concealed base station radio frequency (RF) antenna comprising:

a modified component of a common object constructed from a dielectric material, said said modified component being substituted for a normal component of the common object; and an antenna array mounted inside the modified component so that the antenna is not visible to an observer, and the modified component appears to be a normal part of the common object.

15. The concealed base station RF antenna of claim 14 wherein the modified component is an elongate tube that is normally found in an urban setting and does not appear to be an antenna housing.

16. A concealed base station radio frequency (RF) antenna comprising:

a modified panel-like component of a common structure that is constructed from a dielectric material, and is substituted for a normal component of the common structure; and at least one antenna element and associated antenna components mounted behind the panel-like component in a position in which the antenna radiates through the dielectric panel-like component, and is not visible from in front of the panel-like component.

17. The concealed base station RF antenna of claim 16 wherein the shape of the panel-like component duplicates a panel-like component selected from the group consisting of:

a billboard;

a street sign;

a building spandrel panel;

a building roof panel;

a ceiling tile; and a building wall panel.

18. The concealed base station RF antenna of claim 17 wherein the antenna comprises a plurality of antenna elements mounted in an array configuration.

19. A method of deploying a plurality of distributed, invisible, cellular base station radio frequency (RF) antennas and antenna subsystems, said method comprising the steps of:

concealing each antenna in a common structural object having a geographic location and sufficient vertical height for the antenna to provide RF coverage of a desired area;

electronically connecting each antenna to an associated antenna subsystem; and electronically connecting each antenna subsystem to an intelligent controller that manipulates the RF coverage area of the plurality of antennas through the associated antenna subsystems.

20. The method of claim 19 wherein the step of concealing each antenna in a common structural object includes concealing each antenna inside a common pole-like object constructed of dielectric material.

21. The method of claim 19 wherein the step of concealing each antenna in a common structural object includes concealing each antenna behind a common panel-like structure constructed of dielectric material.

22. The method of claim 19 wherein the step of concealing each antenna in a common object includes the steps of:

concealing a first subset of the plurality of antennas inside a plurality of common pole-like objects constructed of dielectric material; and concealing a second subset of the plurality of antennas behind a plurality of common panel-like structures constructed of dielectric material.

23. The method of claim 19 wherein each of the antennas comprises a plurality of antenna elements configured to form an array, and the step of electronically connecting each antenna to an associated antenna subsystem includes connecting each antenna array to a beam forming and steering subsystem which controls an antenna pattern created by each antenna array.

24. The method of claim 23 further comprising the steps of:

detecting that one of the plurality of antennas has malfunctioned;

determining, in the intelligent controller, whether a blind spot has been created by the malfunctioning antenna; and directing, by the intelligent controller, the beam forming and steering subsystems of antennas neighboring the malfunctioning antenna to reform and redirect their antenna patterns to cover the blind spot, upon determining that a blind spot has been created by the malfunctioning antenna.

25. The method of claim 23 wherein the antenna elements are configured to utilize linear polarization, and circular polarization, and the method further comprises the steps of:

determining, in the intelligent controller, whether performance would be optimized by utilizing circular polarization; and utilizing circular polarization upon determining that performance would be optimized by utilizing circular polarization.

26. The method of claim 19 wherein the steps of electronically connecting each antenna to an associated antenna subsystem, and electronically connecting each antenna subsystem to an intelligent controller include establishing at least one radio link between the intelligent controller and an antenna subsystem.

27. The method of claim 19 wherein the steps of electronically connecting each antenna to an associated antenna subsystem, and electronically connecting each antenna subsystem to an intelligent controller include establishing at least one fiber-optic link between the intelligent controller and an antenna subsystem.

28. The method of claim 19 further comprising establishing a radio link between the intelligent controller and a satellite.

29. The method of claim 19 wherein a plurality of the antennas and antenna subsystems are concealed in a single structural object, and the method includes controlling, by the intelligent controller, the plurality of antennas and antenna subsystems in the single structural object to form a master antenna.

30. The method of claim 29 further comprising utilizing the master antenna to serve a primary base station within an urban supercell.

31. A method of enabling wireline voice and data terminals within a premises to communicate over a wireless telecommunications network, said method comprising the steps of:

installing an antenna-transceiver subsystem on the premises which converts incoming communications from the wireline voice and data terminals to radio frequency (RF) communications, the antenna-transceiver subsystem being concealed as part of a common structural object on the premises so that the antenna-transceiver subsystem is invisible to an observer; and connecting the wireline voice and data terminals to the antenna-transceiver subsystem.

32. The method of claim 31 further comprising the steps of:

installing a radio base station for the wireless telecommunications network near the premises, the radio base station being concealed in a common structural object and having an antenna pattern which covers the premises; and establishing RF communications between the antenna-receiver subsystem and the radio base station.

33. A radio frequency (RF) antenna concealed in a pole-like object comprising:

a microstrip feed circuit;

a first dielectric layer adjacent the microstrip feed circuit;

a first ground plane having at least one aperture therein adjacent the first dielectric layer and opposite the microstrip feed circuit;

a second dielectric layer adjacent the first ground plane and opposite the first dielectric layer;

a first layer of microstrip radiating elements adjacent the second dielectric layer and opposite the first ground plane, the microstrip radiating elements being energized by an electromagnetic field generated by the microstrip feed circuit and passing through the apertures in the first ground plane;

a third dielectric layer adjacent the first layer of microstrip radiating elements and opposite the second dielectric layer;

a second layer of microstrip radiating elements adjacent the third dielectric layer and opposite the first layer of microstrip radiating elements, the radiating elements in the second layer being energized by an electromagnetic field generated by the feed circuit and passing through the apertures in the first ground plane, and each element in the second layer being rotated 90 degrees in the plane of the layer from the orientation of the elements in the first layer of radiating elements; and a dielectric lens layer adjacent the second layer of microstrip radiating elements and opposite the third dielectric layer.

34. The RF antenna of claim 33 further comprising an outer protective radome adjacent the second layer of microstrip radiating elements and opposite the third dielectric layer.

35. A radio frequency (RF) antenna suitable for concealing in a pole-like object comprising:

a first ground plane formed as a tube to fit within the pole-like object;

a first concentric dielectric layer adjacent the first ground plane;

a concentric stripline feed circuit adjacent the first dielectric layer and opposite the first ground plane;

a second concentric dielectric layer adjacent the stripline feed circuit and opposite the first dielectric layer;

a second concentric ground plane having at least one aperture therein adjacent the second dielectric layer and opposite the stripline feed circuit;

a third concentric dielectric layer adjacent the outer ground plane and opposite the second dielectric layer; and a first concentric layer of radiating elements adjacent the third dielectric layer and opposite the second ground plane, the radiating elements being energized by an electromagnetic field generated by the stripline feed circuit and passing through the apertures in the second ground plane.

36. The RF antenna of claim 35 further comprising:

a fourth concentric dielectric layer adjacent the first layer of radiating elements and opposite the third dielectric layer; and a second concentric layer of microstrip radiating elements adjacent the fourth dielectric layer and opposite the first layer of microstrip radiating elements, the radiating elements in the second layer being energized by an electromagnetic field generated by the stripline feed circuit and passing through the apertures in the second ground plane, and each element in the second layer of elements being rotated 90 degrees in the plane of the layer from the orientation of the elements in the first layer of radiating elements.

37. The RF antenna of claim 36 further comprising a concentric dielectric lens layer adjacent the second layer of microstrip radiating elements and opposite the fourth dielectric layer.

38. The RF antenna of claim 36 further comprising a concentric outer protective radome adjacent the second layer of microstrip radiating elements and opposite the fourth dielectric layer.

* * * * *